US008770195B2

(12) United States Patent
Stone et al.

(10) Patent No.: US 8,770,195 B2
(45) Date of Patent: Jul. 8, 2014

(54) MOUTH PIECE FOR A BREATHING APPARATUS

(75) Inventors: William C. Stone, Del Valle, TX (US); Jorgen Sahibzada, Vastra Frolunda (SE)

(73) Assignee: Poseidon Diving Systems AB, Vastra Frolunda (SE)

( * ) Notice: Subject to any disclaimer, the term of this patent is extended or adjusted under 35 U.S.C. 154(b) by 745 days.

(21) Appl. No.: 12/740,208

(22) PCT Filed: Oct. 29, 2008

(86) PCT No.: PCT/SE2008/051226

§ 371 (c)(1),
(2), (4) Date: Nov. 23, 2010

(87) PCT Pub. No.: WO2009/058080

PCT Pub. Date: May 7, 2009

(65) Prior Publication Data

US 2011/0073111 A1 Mar. 31, 2011

Related U.S. Application Data

(60) Provisional application No. 61/000,715, filed on Oct. 29, 2007.

(51) Int. Cl.
*A62B 9/02* (2006.01)

(52) U.S. Cl.
USPC ..... 128/205.24

(58) Field of Classification Search
USPC ..... 128/201.27, 205.12, 205.18, 205.24, 128/205.26, 205.28, 204.26
See application file for complete search history.

(56) References Cited

U.S. PATENT DOCUMENTS 4,273,120 A 6/1981 Oswell
4,516,424 A 5/1985 Rowland
(Continued)

FOREIGN PATENT DOCUMENTS

CA 2 564 999 11/2005
DE 297 10 307 9/1997
(Continued)

OTHER PUBLICATIONS

Baily et al. "Performance of Diving Equipment" Health and Safety Laboratory Copyright 2006.*
(Continued)

*Primary Examiner* — Jackie T Ho
*Assistant Examiner* — Mark Wardas
(74) *Attorney, Agent, or Firm* — Nixon & Vanderhye P.C.

(57) ABSTRACT

The present invention relates to a mouth piece for a breathing apparatus, a breathing apparatus and a method for adjusting a valve trigger mechanism arranged on a mouth piece for a breathing apparatus. The mouth piece according to the present invention comprises a housing comprising a mouth piece breathing part opening for inhaling and exhaling a breathable gas. An inlet port for providing breathable gas into said mouth piece housing, the inlet port being in communication with valve means arranged to open or close said inlet port. The housing further comprises a first exit port for exhausting gas from said housing into a closed circuit flow channel and a second exit port for exhausting gas from said mouth piece housing into an ambient environment. Switch means for selectively directing said exhaust gas between said first exit port and said second exit port to change the mouth piece between open circuit breathing and closed circuit breathing. The switch means is arranged to adjust the valve means so as to provide an automatic diluent valve function in closed circuit mode and an open circuit regulator in open circuit mode. The mouth piece according to the present invention is compact, light weight and provides for a mouth piece which is very simple to handle.

31 Claims, 15 Drawing Sheets

(56) References Cited

U.S. PATENT DOCUMENTS

| | | | | |
|---|---|---|---|---|
| 4,964,404 | A | 10/1990 | Stone | |
| 5,094,235 | A | 3/1992 | Westenskow et al. | |
| 5,127,398 | A * | 7/1992 | Stone | 128/204.18 |
| 5,503,145 | A * | 4/1996 | Clough | 128/204.22 |
| 6,003,513 | A | 12/1999 | Readey et al. | |
| 6,279,574 | B1 | 8/2001 | Richardson et al. | |
| 6,470,885 | B1 | 10/2002 | Blue et al. | |
| 6,520,180 | B1 | 2/2003 | Sahmkow et al. | |
| 6,712,071 | B1 | 3/2004 | Parker | |
| 6,817,359 | B2 | 11/2004 | Deas et al. | |
| 7,353,824 | B1 | 4/2008 | Forsyth et al. | |
| 8,302,603 | B1 | 11/2012 | Weber | |
| 8,424,522 | B2 | 4/2013 | Sieber | |
| 2003/0127133 | A1 | 7/2003 | Kim | |
| 2003/0188745 | A1 | 10/2003 | Deas et al. | |
| 2005/0247311 | A1 | 11/2005 | Vacchiano et al. | |
| 2006/0201508 | A1 | 9/2006 | Forsyth et al. | |
| 2007/0235030 | A1 * | 10/2007 | Teetzel et al. | 128/205.12 |
| 2009/0250062 | A1 * | 10/2009 | Reynolds | 128/205.24 |
| 2011/0041848 | A1 | 2/2011 | Stone et al. | |
| 2011/0114094 | A1 | 5/2011 | Stone et al. | |

FOREIGN PATENT DOCUMENTS

| | | |
|---|---|---|
| DE | 100 14 959 | 5/2001 |
| GB | 2 208 203 | 3/1989 |
| GB | 2 340 760 | 3/2000 |
| GB | 2 404 593 | 2/2005 |
| WO | WO 99/04858 | 2/1999 |
| WO | WO 2005/107390 | 11/2005 |
| WO | WO 2007/126317 | 11/2007 |
| WO | WO 2008/080948 | 7/2008 |

OTHER PUBLICATIONS

International Search Report for PCT/SE2008/051226, mailed Jan. 23, 2009.

Written Opinion of the International Searching Authority for PCT/SE2008/051226, mailed Jan. 23, 2009.

International Search Report for PCT/SE2008/051231, mailed Jan. 28, 2009.

Written Opinion of the International Searching Authority for PCT/SE2008/051231, mailed Jan. 28, 2009.

Office Action mailed Oct. 8, 2013 in U.S. Appl. No. 12/740,181.

Office Action mailed Jun. 20, 2013 in U.S. Appl. No. 12/740,194.

International Search Report for PCT/SE2008/051229, mailed Jan. 28, 2009.

Written Opinion of the International Searching Authority for PCT/SE2008/051229, mailed Jan. 28, 2009.

Final Office Action dated Dec. 19, 2013 issued in U.S. Appl. No. 12/740,194.

* cited by examiner

MOUTH PIECE FOR A BREATHING APPARATUS

This application is the U.S. national phase of International Application No. PCT/SE2008/051226, filed 29 Oct. 2008, which designated the U.S. and claims the benefit of U.S. Provisional Appln. No. 61/000,715, filed 29 Oct. 2007, the entire contents of each of which are hereby incorporated by reference.

TECHNICAL FIELD

The present invention relates to a mouth piece for a breathing apparatus and a method for adjusting the mouth piece. Specifically, the mouth piece according to the present invention can advantageously be used in a closed circuit rebreather.

BACKGROUND OF THE INVENTION

Fully closed-cycle underwater breathing apparatus (CCUBA) or alternatively known as "closed-circuit rebreathers", or "CCR" offers distinct advantages over the more common open-circuit (SCUBA) systems, such as reduced bubble noise, extremely high gas usage efficiency, and optimized breathing gas composition.

These advantages derive from the fact that the exhaled breathing gas is recycled, filtered of carbon dioxide, replenished with oxygen, and returned to the diver for breathing again. The lack of bubble noise and the increased gas efficiency of a CCR both result from the fundamental function of recycling the breathing gas. The optimized breathing gas composition results from the fact that the oxygen control system of a CCR maintains a constant partial-pressure of oxygen (rather than a constant fraction of oxygen, as in conventional open-circuit SCUBA).

The partial pressure of a gas is a function of the fraction of the gas multiplied by the ambient pressure. As a diver descends and the depth increases, the ambient pressure also increases. Thus, for a given fraction of oxygen, the partial pressure increases as the depth increases. If the oxygen partial pressure exceeds a certain threshold (approximately 1.4 bar) the risk of hyperoxia-induced seizure and other "oxygen toxicity" symptoms is considered unsafe for the diver. For example, the maximum safe depth at which a diver can breathe a mixture containing 50% oxygen is about 18 meters. On the other hand, the lower the oxygen concentration, the greater the concentration of non-oxygen gas constituents, such as nitrogen or helium. It is these non-oxygen components of the breathing mixture that lead to problems of decompression sickness (DCS), also known as "the bends", which include symptoms ranging from pain in the joints, to paralysis, to death. To maximize the amount of time that can be safely spent at any given depth, the non-oxygen portions of the breathing gas should be kept to a minimum; which means that the oxygen should be kept to its maximum safe limit at all points during the dive.

Thus, the advantage of CCR over conventional open-circuit SCUBA in terms of optimized breathing gas composition results from the fact that a CCR can maintain the maximum safe partial pressure of oxygen ($PO_2$) throughout all depths of a dive, thereby minimizing the concentration of non-oxygen gas constituents—leading to increased allowed time at any give depth and/or reduced risk of DCS.

But this advantage comes at a cost. Whereas the breathing mixture for a conventional open-circuit SCUBA diver is fixed based by the composition of the gas in the supply cylinder, the breathing mixture in a CCR is dynamic. Although it is this dynamic mixture capability that affords CCR one of its primary advantages, a failure of the oxygen control system can be extremely dangerous. A malfunction that allows the $PO_2$ to get too high places the diver at risk of a hyperoxia-induced seizure, almost certainly causing the diver to drown. A malfunction that allows the $PO_2$ to get too low will lead to hypoxic-induced blackout, causing the diver to drown and/or suffer severe brain damage. Therefore, perhaps the most critical aspect of any CCR design involves the reliability of the oxygen control system.

Most modern CCRs incorporate one or more electronic oxygen sensors that directly measure the $PO_2$ of the breathing gas and as well, have an onboard computer processor to analyze the data and to advise the user of the status of the system by means of some sort of display, either digital or analog—typically mounted on the user's wrist and connected to the computer via an electrical cable. In the event of a failure of such electronic sensing and advisory systems it is current practice in CCR diving to have some sort of external open-circuit (traditional) Scuba system available with which to abort to the surface. Finding this auxiliary breathing mouthpiece in the event of an emergency or panic can be fatal if the user is not able to immediately and exactly locate the spare mouthpiece, which is a physically separate object usually clipped either to the emergency gas source or somewhere on the user's life support harness. Experience, and actuarial statistics, support the claim that locating and activating this external mouthpiece is not guaranteed.

One solution to this problem is described in U.S. Pat. No. 5,127,398 Stone and U.S. Pat. No. 5,368,018. The solution was then to design a combined mouthpiece that contains the functionality of both open-circuit and closed-circuit breathing systems such that in the event of an emergency with the closed-circuit system the user can make a simple change to the state of the mouthpiece system to convert directly from closed-circuit to open-circuit operation in the event of an emergency and without ever having to remove the mouthbit.

An additional function that is required of all CCR breathing apparati is the ability to add a breathable gas (i.e. a "diluent" gas) to the compliant volume of the CCR when that compliant volume drops below an amount needed to fill the user's lungs upon inhalation. There are many situations where such an action will be required and it is customary to provide an independent system that consists of a special low pressure regulator that is attached advantageously at a location on the CCR compliant volume (known as a "counterlung") and provides access to a supply of breathable gas, usually from a high pressure tank equipped with a high pressure regulator that thence provides a flow of gas to the low pressure regulator, which is typically in the 8 to 12 bar pressure range. The special low pressure volume compensation regulator is known as an "ADV" (automatic diluent-addition valve).

In the patent publication of GB 2,340,760 A, a mouth piece for a CCR is disclosed which comprises a switch to switch between open circuit breathing and closed circuit breathing. The mouth piece further comprises valve means, which is said to be able to operate automatically and to permit the introduction of breathable gas from a separate source into the system. The mouth piece also comprises manually operable valve means for the addition of a diluent gas. Over all, the mouth piece can be said to provide an automatic diluent function, a manual diluent function and a valve emergency open circuit breathing valve, combined in a single unit.

However, the mouth piece just described provides for several drawbacks, for instance, the sensitivity of the trigger mechanism for the automatic diluent function is changed by altering the value of a spring. Hence this is not a very practical solution, especially not for a diver submerged in water.

There is a need for a more practical mouth piece which provides at least a part of the above mentioned advantages, while at the same time eliminating or minimizing at least a part of the mentioned drawbacks.

SUMMARY OF THE INVENTION

The above mentioned drawbacks are at least partly solved by a mouth piece for a breathing apparatus according to the present invention. The mouth piece comprises valve means (99) comprising a valve trigger mechanism (112) arranged to operatively open and/or close said valve means (99), and a mouth piece housing comprising; a mouth piece breathing part opening, for inhaling and exhaling a breathable gas. An inlet port for providing breathable gas into the mouth piece housing, the inlet port being in communication with said valve means arranged to open and/or close the inlet port. The mouth piece housing further comprises a first exit port, for exhausting and possibly inhaling gas from the mouth piece housing into and possibly out from a closed circuit flow channel, and a second exit port for exhausting gas from the mouth piece housing into an ambient environment. The mouth piece housing further comprises switch means for selectively directing the exhaust gas between the first exit port and the second exit port.

The switch means is further arranged to adjust the opening and closing function of said valve trigger mechanism. Preferably, the opening and closing function is set so as to determine a pressure (e.g. a pressure drop or differential inside the mouth piece housing relative to an ambient fluid pressure—whether atmospheric air, water or other surrounding fluid—or any other pressure or pressure drop occurring on the inside and/or outside of the mouthpiece housing) at which the valve trigger mechanism opens and/or closes the valve means. This includes the possibility that he trigger function may be set such that the valve means remains permanently open or closed during a mission. The present invention provides for a safe, compact, light weight Integrated mouth piece for a breathing apparatus, preferably such as a CCR. It further provides for an automatic diluent valve function independently as whether the mouth piece is arranged for closed circuit breathing or open circuit breathing. The inhaled gas comes from either open circuit or a closed circuit gas flow.

It is noted that the valve trigger mechanism can be adjusted by means of directly influencing the valve trigger mechanism, or by indirectly influencing the valve trigger mechanism e.g. by influencing a feature which triggers the valve trigger mechanism, both of these aspects are meant to be included in the terminology of "adjust the valve trigger mechanism".

In one preferred embodiment of the present invention, the mentioned adjustment is done when selectively directing the exhaust gas between the first and second exit port. Such an embodiment is advantageous since there is no delay of the adjustment when changing between e.g. open circuit breathing to closed circuit breathing. Alternatively, the switch means can be arranged to first adjust the valve trigger mechanism and thereafter to selectively directing the exhaust gas between the first exit port and the second exit port, or, to first selectively directing the exhaust gas between the first exit port and the second exit port and thereafter to adjust the valve trigger mechanism. It is within the inventive concept that the adjustment and the redirecting of the exhaust gas is done by the switch means, i.e. one single operational switch, which the user can operate. In this sense the mouth piece of the present invention provides for a mouth piece which can be used for both open circuit breathing and closed circuit breathing by a user which is not an expert user. The mouth piece thereby introduces closed circuit breathing to e.g. the recreational divers and thereby all the benefits of the CCR systems.

The valve trigger mechanism can be arranged in working cooperation with a flexible diaphragm. The flexible diaphragm is then arranged to trigger the valve trigger mechanism at a pressure threshold. The pressure threshold is determined by the adjustment of the valve trigger mechanism. In the following examples of an embodiment of the present invention, this is done by adjusting the relative distance between the valve trigger mechanism and the flexible diaphragm, since the flexible diaphragm is arranged to trigger the valve trigger mechanism; however other arrangements for adjustments are possible. The pressure threshold (negative pressure differential inside the mouth piece housing relative the external ambient pressure) is about 20-50 mbar, preferably 25-45 mbar, more preferably between 30-40 mbar when the valve means is arranged to direct the exhaust gas to the first exit port. The mentioned pressure threshold ranges provides for a mouth piece according to the present invention, which can be used in an e.g. CCR systems and safely diving relatively deep, without expert knowledge of CCR systems, while still maintaining a proper automatic diluent valve function adapted to a predetermined depth.

When the switch means is arranged to direct the exhaust gas to the second exit port, the pressure threshold (negative pressure differential inside the mouth piece housing relative the external ambient pressure) is about 0.01-8 mbar, preferably 0.1-6 mbar, more preferably <4 mbar. By adjusting the valve trigger mechanism to be respondent to these pressure threshold ranges provides for a mouth piece equivalent to a very high performance dedicated open-circuit regulator.

Dependent on how the switch means and the mouth piece housing is arranged to cooperate, the adjustment of the valve trigger means can comprise moving at least a part of the valve means, and in this embodiment the valve trigger mechanism and the flexible diaphragm, a relative distance with respect to each other. Optionally, the valve trigger mechanism is adjusted by moving the valve trigger mechanism with respect to the flexible diaphragm or by that the valve trigger mechanism is adjusted by moving the flexible diaphragm with respect to the valve trigger mechanism. Combinations of the above are also possible. Independently of which feature that is moved with respect to the other, the relative distance can be between 1-20 mm, preferably 2-10 mm, more preferably 3-8 mm, most preferred between 4-7 mm.

The flexible diaphragm preferably comprises a maximum flex distance FD, within which the flexible diaphragm triggers the valve trigger mechanism. The distance of the movement of the at least a part of the adjustable valve means and the flexible diaphragm relative to each other is not exceeding the maximum flex distance FD.

In one embodiment of the present invention, the adjustment of the valve trigger mechanism is at least partly done by moving at least a part of the valve means back and forth along a first direction A using the switch means, preferably when selectively directing the exhaust gas between the first and second exit port. The mouth piece housing can be formed in a variety of different ways; it may for instance comprise an open circuit segment comprising a substantially cylindrical form. In such an embodiment of the present invention, the open circuit segment comprises a longitudinal axis A, wherein the first direction A is aligned with the longitudinal axis A. Further, the valve means can be arranged at least partly inside the mouth piece housing. Preferably in such a case, the mouth piece housing comprises a substantially cylindrical inner chamber comprising a first and a second end, and the switch means comprises a substantially hollow cylinder at least partly arranged in the substantially cylindrical inner chamber. This embodiment provides for a very tight and compact mouth piece, it further enables the use of very few sealing members (in the following examples below only two sealing members are required) which would otherwise be needed. By using few sealing members, the switch means becomes relatively easy to operate in terms of frictional forces, hence even users which are not considered to be strong, can effectively use and operate the mouth piece according to the present invention. To further make the mouth piece according to the present invention even more compact, the valve means can be at least partly arranged inside the switch means; preferably the switch means comprises a switch barrel wherein the valve means is at least partly arranged inside said switch barrel.

In an embodiment of the present invention, the valve means is moved between a first and a second position in order to adjust said valve trigger mechanism. The valve means is preferably moved with a helical motion between the first and a second position. Such helical motion can be achieved by means of a helical formed thread and means for cooperating with the helical formed thread. Optionally the switch means comprises a first and a second end wherein only the second end of the switch means is arranged between the first and second end of the cylindrical inner chamber.

In one embodiment of the present invention, the inlet port for providing breathable gas into the housing is provided via the switch means. This embodiment is further emphasising the compact properties of a mouth piece according to the present invention.

The mouth piece according to the present invention can further be arranged with at least one sensor device, the sensor device being arranged to detect the position of the switch means. The sensor device can further be arranged to be in communication with a processing unit, such as a computer, the processing unit being in communication with a second sensor device, wherein the second sensor device is arranged to detect the status of the breathable gas. The mouth piece can further comprise a display in communication with the sensor device, the display being arranged to indicate, as a response to a signal from the processing unit or the sensor device, that the switch means for safety reasons needs to be redirected.

The present invention further comprises a mouth piece for a breathing apparatus, the mouth piece comprising valve means (99) comprising a valve trigger mechanism (112) arranged to operatively open and/or close said valve means (99), and a mouth piece housing comprising; a mouth piece breathing part opening, for inhaling and exhaling a breathable gas, an inlet port for providing breathable gas into the mouth piece housing, the inlet port being in communication with valve means. The valve means comprises a valve trigger mechanism arranged to open and/or close the valve means and thereby the inlet port. The housing further comprising a first exit port for exhausting and possibly inhaling gas from the housing into and possibly out from a closed circuit flow channel, a second exit port for exhausting gas from the mouth piece housing into an ambient environment, switch means for selectively directing the exhaust gas between the first exit port and the second exit port so as to switch between a closed circuit and an open circuit. The valve means provides an automatic diluent valve function operable in said closed circuit and the valve means provides an open circuit regulator function operable in the open circuit. The switch means is arranged to actuate said valve means to switch between the automatic diluent valve function and the open circuit regulator function.

The present invention provides for a valve which operates as an ADV operable in closed circuit mode and a valve which functions as an open circuit regulator in open circuit mode. Hence, if the user requires more breathing gas volume while operating in closed-circuit mode and to provide that additional gas with the least work of breathing while simultaneously preventing wasteful premature triggering of breathing (diluent) gas addition. By a change of internal geometry of the system which subsequently changes (increases or decreases) the trigger threshold differential pressure so that the ADV provides appropriate gas volume when required in e.g. closed-circuit mode and yet provides no more than necessary while preventing wasteful gas use through premature triggering. This change of internal geometry of the system can be implemented and by that the pressure threshold is changed by means of adjusting the valve trigger mechanism by means of the switch means. In one embodiment, the valve trigger mechanism is adjusted by means of moving the valve trigger mechanism a distance along a first direction A. Further, mouth piece housing preferably comprises a flexible diaphragm wherein the valve trigger mechanism is arranged in working cooperation with the flexible diaphragm to activate the automatic diluent valve.

The present invention further comprises a method of adjusting the opening and closing function of a valve trigger mechanism in a valve means (99) arranged on a mouth piece for a breathing apparatus comprising the steps of;

providing a mouth piece, the mouth piece comprises a mouth piece housing comprising;

a mouth piece breathing part opening, for inhaling and exhaling a breathable gas, an inlet port for providing breathable gas into the mouth piece housing, the inlet port being in communication with valve means arranged to open or close the inlet port.

The housing further comprising a first exit port, for exhausting and possibly inhaling gas from the housing into and possibly out from a closed circuit flow channel, a second exit port, for exhausting gas from the mouth piece housing into an ambient environment, switch means for selectively directing the exhaust gas between the first exit port and the second exit port so as to switch between a closed circuit and an open circuit. The adjustment of the valve trigger mechanism is done by means of redirecting the switch means between the first and second exit port.

BRIEF DESCRIPTION OF THE DRAWINGS

The present invention will be described in greater detail with reference to the accompanying figures, in which.

DETAILED DESCRIPTION OF PREFERRED EMBODIMENTS

A mouth piece according to an embodiment of the present invention will be described in greater detail using the following examples by means of a CCR apparatus; however, the mouth piece can be used with any kind of breathing apparatus.

Figure 1:
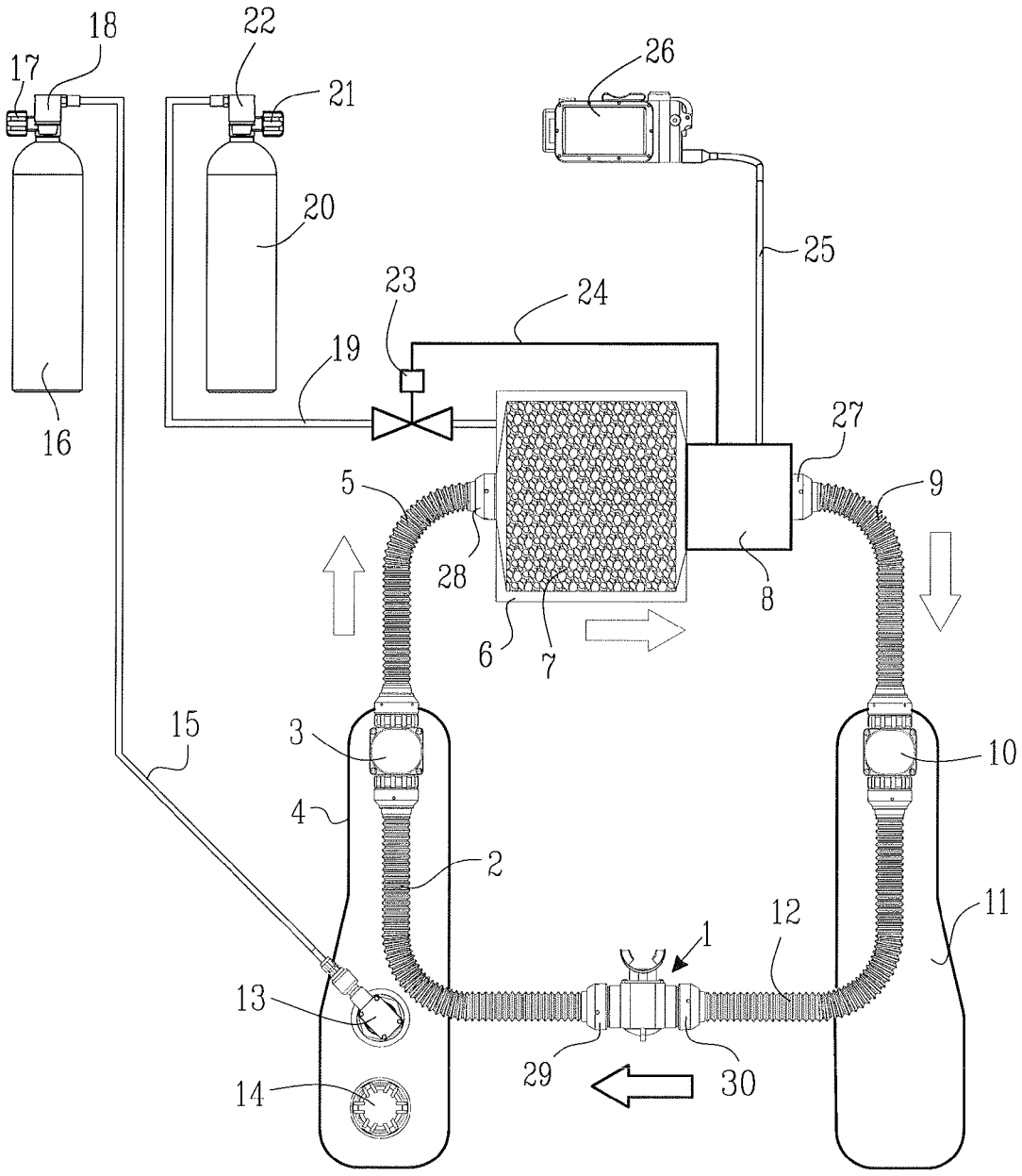
FIG. 1 shows a schematic overview of a closed circuit rebreather in which the present invention can be utilized.

FIG. 1 shows in schematic mode a typical modern CCR architecture, e.g. as elaborated similarly in the U.S. Pat. No. 5,127,398 mentioned above. The general operation of such a CCR is as follows: the user breathes into a mouthpiece 1 that contains checkvalves (not shown) that enforce the flow of gas in a preferential direction (indicated by the arrow). The expelled gas (from exhalation) travels down breathing hose 2 and into junction block 3 which permits passage of the gas into a counterlung 4, i.e. a flexible bladder. In advanced CCR designs e.g. such as in the U.S. Pat. No. 5,127,398 document, two counterlungs are used. Further in FIG. 1, an exhalation counterlung 4 and an inhalation counterlung 11 is utilized such that each has a volume equal to about half the exhalation volume of the diver. When the exhalation counterlung 4 fills the gas then continues through junction block 3 and through breathing hose 5 which carries the gas to a hose junction 28 with a gas processing unit 6. Inside the gas processing unit the gas is passed through a carbon dioxide removal means 7, which frequently takes the form of an absorbent that chemically reacts with the gaseous carbon dioxide to form a carbonate molecule. The clean gas then continues on to Electronics Module 8 that performs the critical sensing and control functions of the CCR, which preferably comprises at least the following tasks:

- Sense the partial pressure of oxygen (PO2) of the breathing gas
- Determine whether the measured PO2 is below acceptable limits
- Open a valve to add oxygen if the PO2 is too low
- Send a signal to a display that displays the current PO2

Furthermore, pure oxygen contained in a pressure vessel 20 with manual tank valve 21 and first stage regulator 22 sends pure oxygen gas at reduced pressure (generally at 8 to 12 bar pressure) through tube/hose means 19 to electronically controlled valve (solenoid) 23 which is connected to the Electronics Module by an electrical control cable 24.

There are many variations on the above and the decision making process can be either performed using analog or digital electronics, although the later has almost entirely supplanted the former in the last decade. It is common now to have cable 25 (or wireless data relay means) leading from the Electronics Module to a display 26 that can provide sophisticated amounts of alphanumeric and symbolic information to the user relating to the status of the apparatus and, as well, tactical information both direct (e.g. present depth, tank supply gas pressures) as well as derived (e.g. decompression status, maximum depth etc) information.

The breathing gas then exits the Gas Processing Unit at manifold 27, travels through hose 9 to junction block 10 and enters the inhalation counterlung 11 which continues to fill up until the volume of gas in counterlung 11 combined with that in counterlung 4 comprise the complete volume of gas exhaled by the user (assuming no loss). Upon inhalation, the diver first draws air (through mouthpiece 1) from the inhalation counterlung 11 until it collapses, whereupon gas remaining in exhalation counterlung 4 is pulled through the Gas Processing system as described previously until the diver's lungs are full.

If a diver is descending during this cycle of breathing the volume of gas in the system is reduced due to hydrostatic compression and the amount of gas inhaled by the user will be less than is required to achieve full lung volume. At this point exhalation counterlung 4 collapses and activates a diluent gas addition valve 13 which automatically provides sufficient gas to allow the user to complete inhalation where upon it ceases to add diluent gas to the system. The diluent gas which is supplied to valve 13 is provided by a pressure vessel 16 containing a supply of a breathable diluent gas. The pressure vessel contains a shutoff valve 17 and first stage regulator 18 which reduces the pressure to between 8 to 12 bar typically and supplies this gas via tube 15 to the counterlung "Automatic Diluent Valve" or "ADV" 13 which acts as described above. When a user is ascending from depth, the reverse occurs and the user's exhaled lung volume will eventually exceed the combined volumes of counterlungs 4 and 11 and the rise in system pressure will trigger a pressure relief valve 14 that dumps the excess gas overboard. The user may then be free to initiate the next breath. There are many variations on this theme but the above comprises the fundamental basics of modern digitally-controlled CCR apparatus, to which the subsequent invention disclosures herein pertain.

Figure 2:
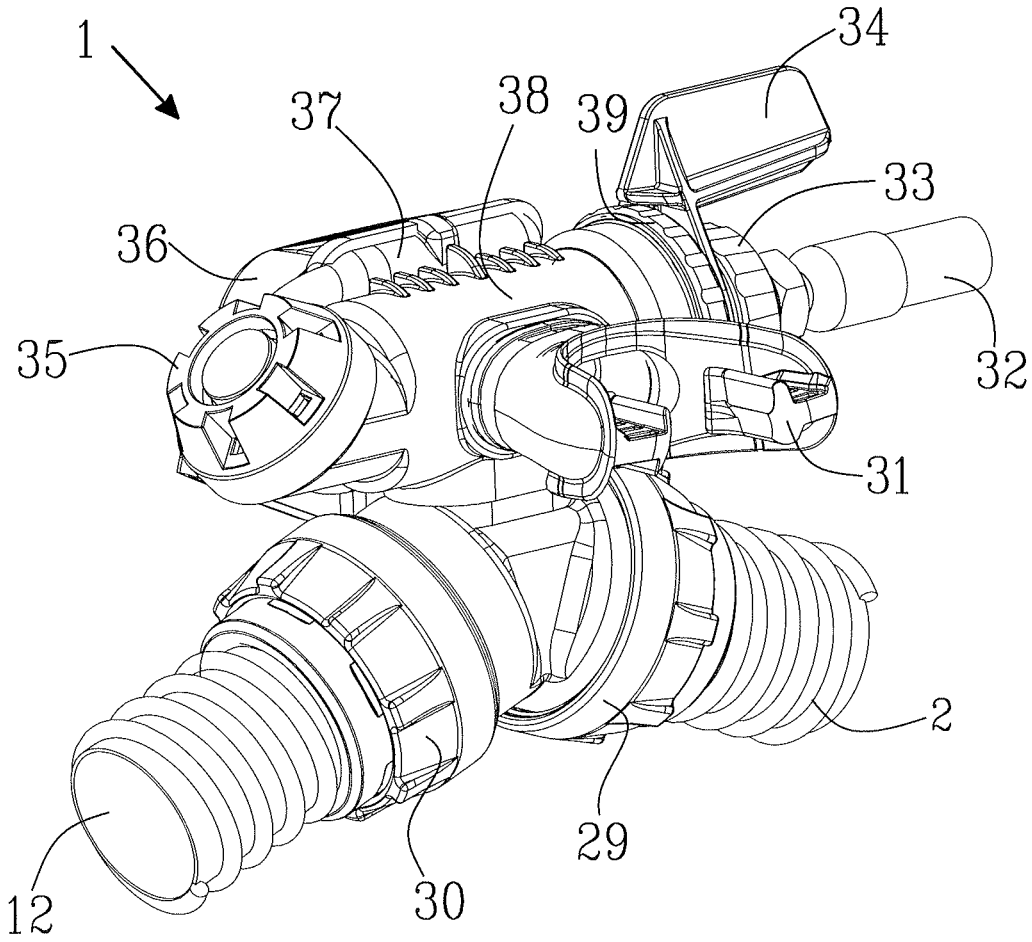
FIG. 2 shows a mouth piece according to the present invention seen in perspective with a view towards the mouthbit.

Referring to FIG. 2, FIG. 2 shows a mouth piece 1 according to an embodiment of the present invention. The mouth piece 1 comprises a switch lever 34, which when in the position shown in FIG. 2 of the mouthpiece 1 operates in a closed-cycle mode, with the breathing gas being recycled, the metabolically-generated carbon dioxide being removed, and pure oxygen added automatically following the description associated with FIG. 1.

In closed-circuit mode, breathing gas is returned from the gas processor to the user via a flexible hose 12 (illustrated as a part of hose 12 as shown in FIG. 1) that is connected to a mouth piece housing 38 by means of a fitting preferably in the form of a fastening ring 30, which creates a water tight seal between the flexible hose 12 and the mouth piece housing 38. Inhaled breathing gas is then drawn up through internal cavities in housing 38 and through a mouthbit 31 to a user during use. Exhaled breathing gas from the user enters mouthbit 31 and passes through internal cavities in housing 38 to exhalation (or "downstream") breathing hose 2, which is attached to housing 38 by means of a fitting 29 which creates a water tight seal between a flexible hose 2 (illustrated as a part of hose 2 as shown in FIG. 1) and the mouth piece housing 38.

To switch to open-circuit mode of operation, the switch lever 34 is preferably rotated clockwise, preferably by approximately 90-degrees (clockwise, i.e. in the direction of rotation that moves the switch lever 34 further away from mouthbit 31. This operation, and its consequences, will be described in greater detail below.

Figure 4:
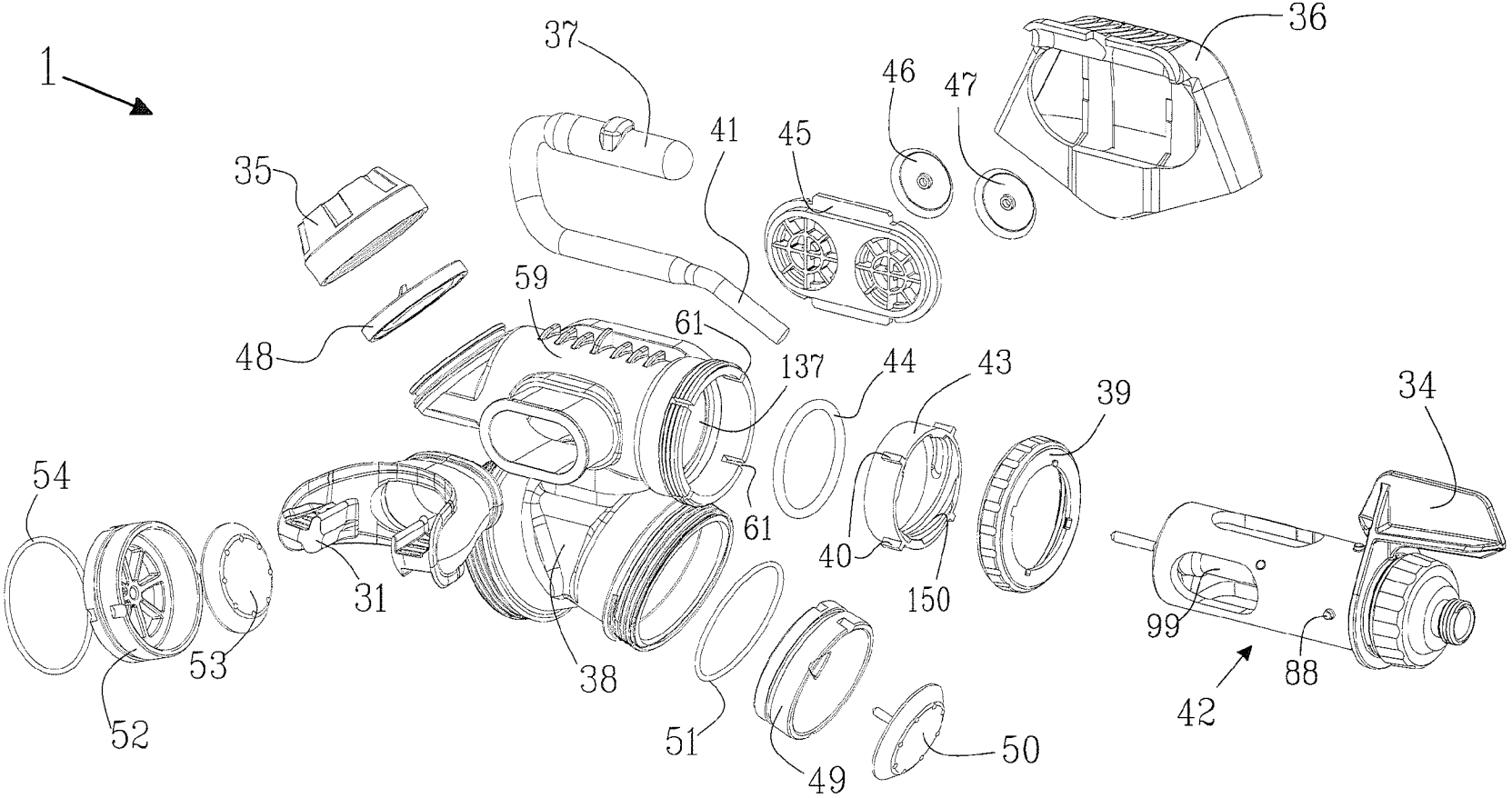
FIGS. 4-5 shows a mouth piece according to the present invention in exploded view.
Figure 6:
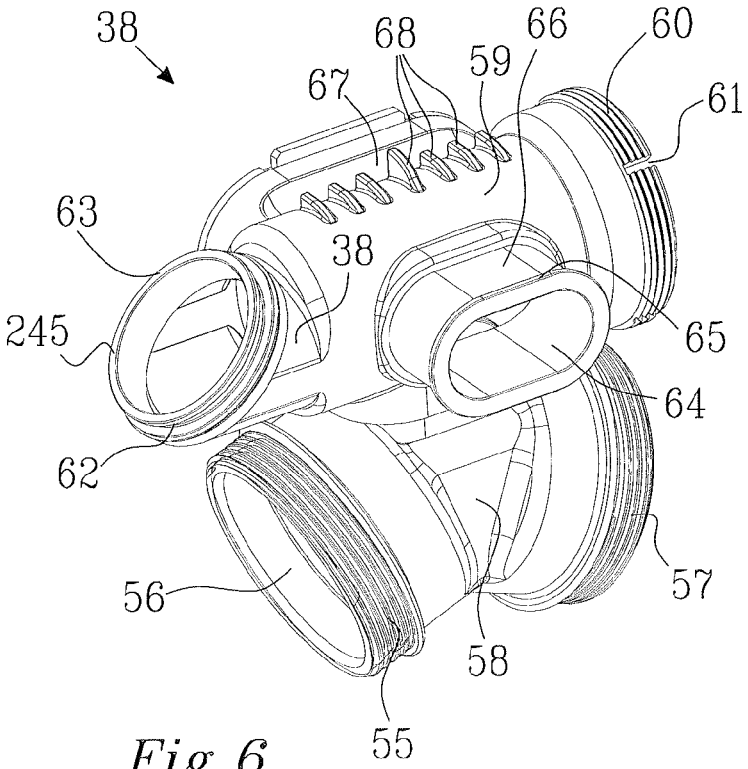
FIGS. 6-7 shows a mouth piece housing in perspective.

The top half of mouth piece housing 38 can, in this embodiment of the present invention, be considered to be devoted to open-circuit operation, and the additional function of the automatic diluent-addition valve (ADV), in the sense that those features are contained in that top half (cf. e.g. FIGS. 4 and 6 showing the open-circuit segment 59). Both the open-circuit gas addition system, and that for the ADV, is enabled by adjusting a valve trigger mechanism and the use of e.g. a flexible diaphragm that responds to differential pressure, specifically negative pressure relative to ambient pressure.

An exhaust manifold 36 for open circuit mode is located on the front of the mouthpiece. Low pressure gas from a remote source of breathing gas (i.e. diluent gas that is normally directly breathable at the operating depth of the device) is delivered to the mouthpiece 1 by a flexible hose 32 (partly shown) which is secured to the mouthpiece by means of securing means 33. At least a part of a switch barrel 100 (cf. e.g. FIG. 9) is held into the housing by means of securing means 39.

Figure 3:
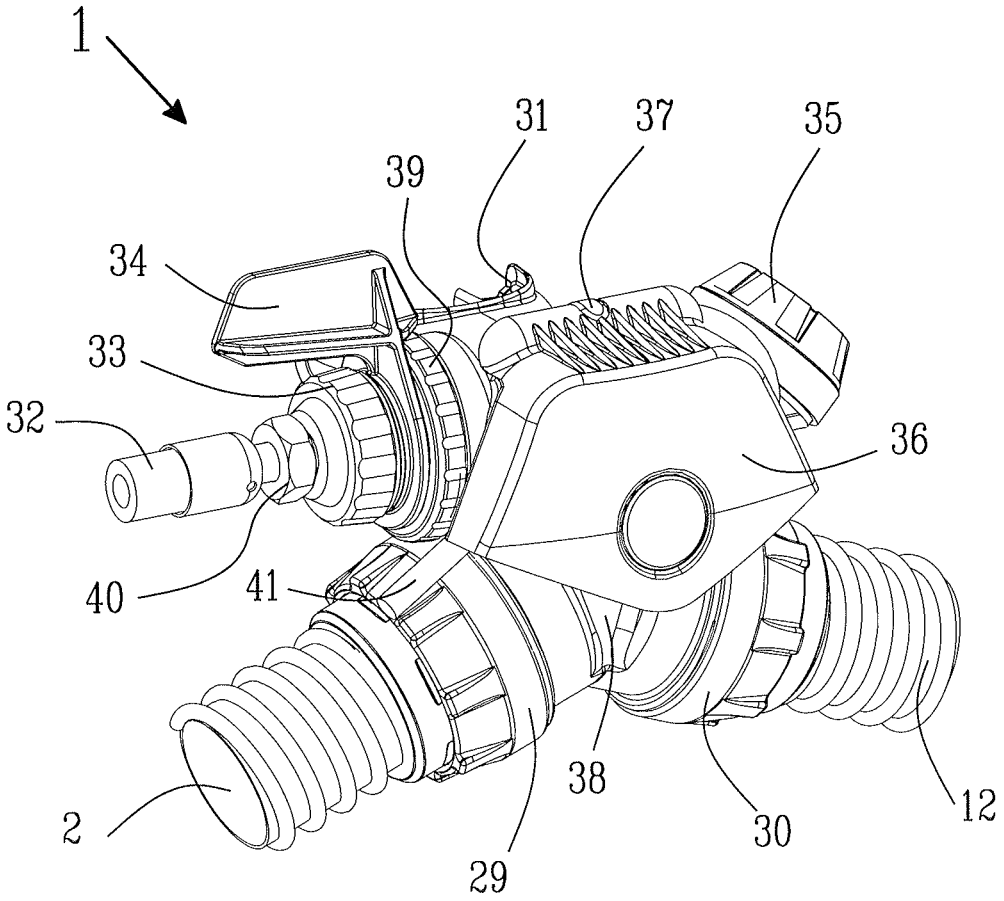
FIG. 3 shows a mouth piece according to the present invention seen in perspective with a view towards the exhaust manifold.

FIG. 3 shows a front view of the assembled embodiment of the present invention with the same descriptive elements as FIG. 2.

Turning to FIG. 4, FIG. 4 shows an exploded view in perspective of an embodiment of the present invention. The top half (the portion devoted to open-circuit breathing, i.e. the open-circuit segment 59) of the housing 38 is arranged to receive switch means 42 in a substantially cylindrical inner chamber 137. The switch means 42 comprises, in this embodiment of the present invention, an open-circuit second stage regulator 99 (described in greater detail below) as an axially concentric component along with the switch means 42 with its relevant open and closed circuit gas pathways and sealing means. Although the term "open-circuit second stage regulator 99" is used herein, it is to be noted that an open circuit regulator may be used or any other regulator or valve which can be adjusted according to the present invention. Switch means 42 is held in place in the mouth piece housing 38 by retainer means 39. The switch means 42 engages high helix screw means 43, in the form of a nut. The high helical screw means 43 inserts into mouth piece housing 38 and engages slots 61 that prevent it from rotating. When the switch lever 34 on switch means 42 is turned, special pins 88 (described below) engage nut 43 and cause switch means 42 to rotate and translate relative to the fixed reference frame of the cylindrical inner chamber 137 of mouth piece housing 38. Sealing means 44 ensures that the switch means 42 can rotate freely but also prevent any environmental gas or liquid from entering mouth piece housing 38. The nut 43 could in alternative embodiment of the present invention be replaced by a machined helix in the housing 38, as such, it is possible that the helix rotation-translation activation means could be integral to the housing 38 and not require a separate insert part.

The high helical screw means 43 comprises Internal high pitch (helical) threads 150 which is arranged on at least a part of the interior surface of the high helical screw means 43 which is designed to engage the projecting guide pins 88 on switch means 42 such that when lever 34 is turned clockwise, the switch means 42 and all its attachments will be rotated and translated into the mouth piece housing 38. External tabs 40 on the high helical screw means 43 are designed to engage slots 61 in the open-circuit segment 59 of mouth piece housing 38 such that rotation of the high helical screw means 43 is prevented.

Mouth piece housing 38 comprises an exhaust plenum 45 that provides the exhaust gas exit pathway, but only for operation in open-circuit mode. When operated in open-circuit mode it is crucial that upon inhalation no fluid (air, water, or other media) is drawn in through exhaust plenum 45. Otherwise such fluid might deter the operation of the open-circuit second stage regulator 99 utilizing a flexible diaphragm 48, the operation of which will be explained in more detail later. To prevent this possibility, and yet allow the exhausting of exhaled breathing gas through exhaust plenum 45, the mouth piece incorporates two checkvalve means 46 and 47 which operate side by side in parallel. This dual exhaust checkvalve feature reduces the exhaust back pressure associated with venting of exhaled gas and thereby improves the functional operation of the open-circuit mode of the integrated mouthpiece 1 relative to existing dedicated open-circuit regulators. Exhaust diversion cover 36 both serves to cover and protect checkvalve means 46 and 47 and also to divert the exhaled breathing gas downward and outward relative to the user's mouth. This has the effect of allowing a clear field of vision for the user when the system is operated in open-circuit mode while underwater, since bubbles are thus diverted down and out from the user's diving mask or helmet.

Figure 5:
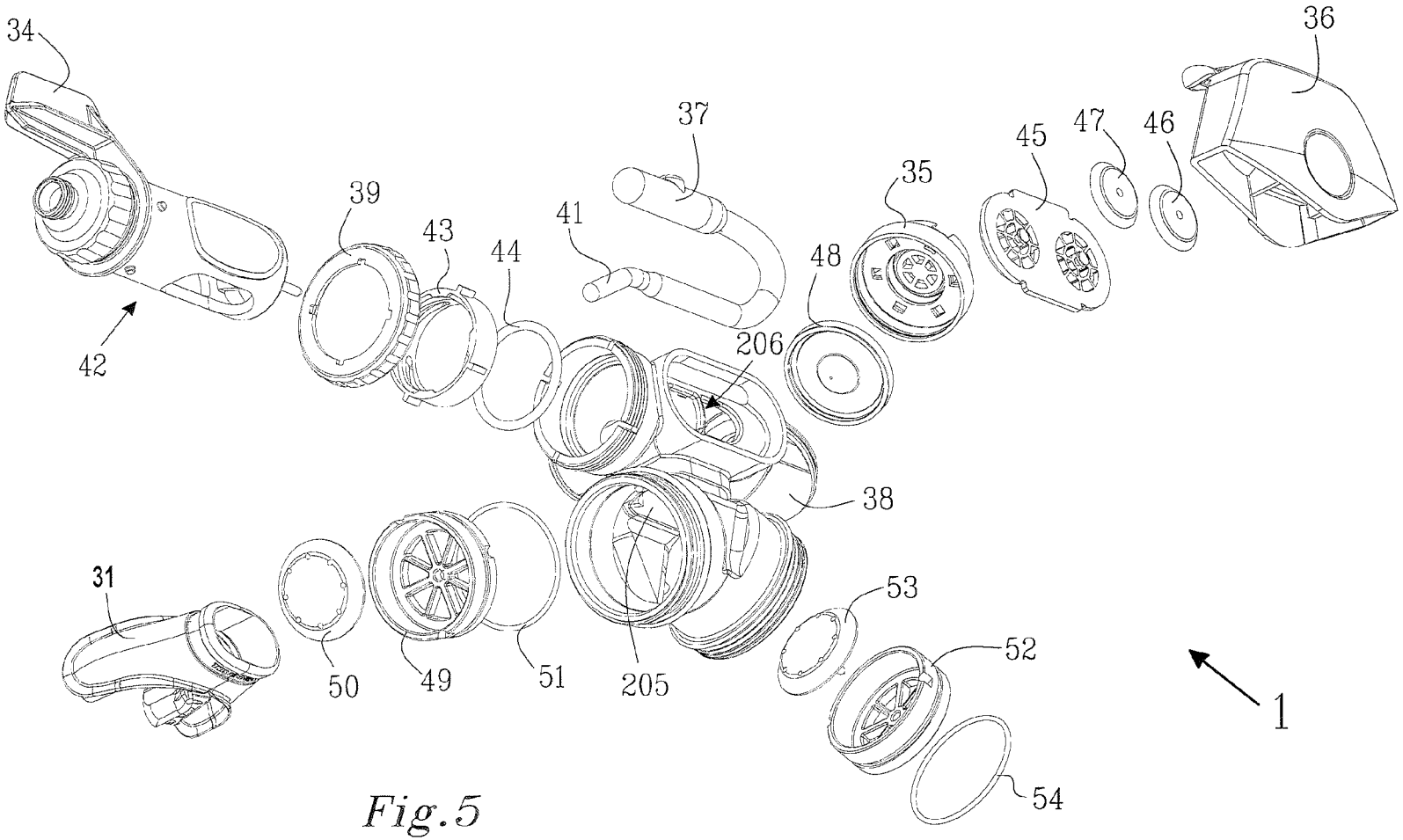

FIG. 5 shows a front exploded view of a mouth piece according to the present invention in the closed-circuit mode position. All component numbers are as previously described in FIG. 4.

FIG. 6 shows a rear isometric view of the bare mouth piece housing 38. Starting at the bottom and working upwards, closed-circuit segment 58 of the mouth piece housing 38 contains external fastening means (threads in this example) 55 and 57, which permit the secure and fluid-tight connection of flexible hoses 12 and 2, respectively by hose attachment means 30 and 29 (shown in FIG. 1), respectively. Inlet sealing surface 56 permits the creation of a fluid-tight seal between flexible hose 12 and mouth piece housing 38 by means of combined sealing and fastening ring 30.

Referring now to the open-circuit segment 59, i.e. the top half of mouth piece housing 38, mouthbit 31 is attached to open-circuit segment 59 along structural surface 66 by any locking securing means (e.g. commonly available snap ties). Ridge 65 provides a locking mechanism that provides further shear resistance to the removal of mouthbit 31 once it is installed. The user's exhaled breath passes through mouthbit 31 and into a mouth piece breathing part opening 64 for inhaling and exhaling a breathable gas, in mouth piece housing 38. The flexible diaphragm 48 (cf. e.g. FIGS. 4 and 5) is preferably arranged on the open-circuit segment 59, preferably by snap fastening and preferably through the use of radial groove 62. This creates a fluid-proof seal with respect to a flat surface 63. In addition, an open-circuit diaphragm trigger portion 35 (cf. e.g. FIGS. 4 and 8) is preferably arranged on open-circuit segment 59 such that the trigger portion 35 can actuate the flexible diaphragm 48 as will be explained in more detail later, It is preferred that the open-circuit trigger portion 35 is arranged tilted at an angle relative to a substantially horizontal longitudinal axis A (cf. FIGS. 13 and 14) of the open-circuit segment 59. In the preferred embodiment of the present invention, this angle is set at approximately 45-degrees. Setting this angle to approximately 45-degree reduces the overall external dimensions of the integrated mouthpiece 1 while simultaneously providing the lowest achievable differential pressures needed to trigger the open-circuit second stage regulator 99 in each of two modes of operation that will be described in detail below.

Cylindrical groove 67 in open-circuit segment 59 of the mouth piece housing 38 provides a receptacle for Head-up Display (HUD) 37, while curved, smooth projecting fins 68 secure HUD 37 into housing 59 with a snap fit. Threaded attachment means 60 allows the switch means 42 to be fastened to open-circuit segment 59 by fastener means 39. A plurality of slotted grooves 61 allow for the engagement of helix nut 43 such that in the preferred embodiment of the invention nut 43 cannot turn relative to housing 38.

Figure 7:
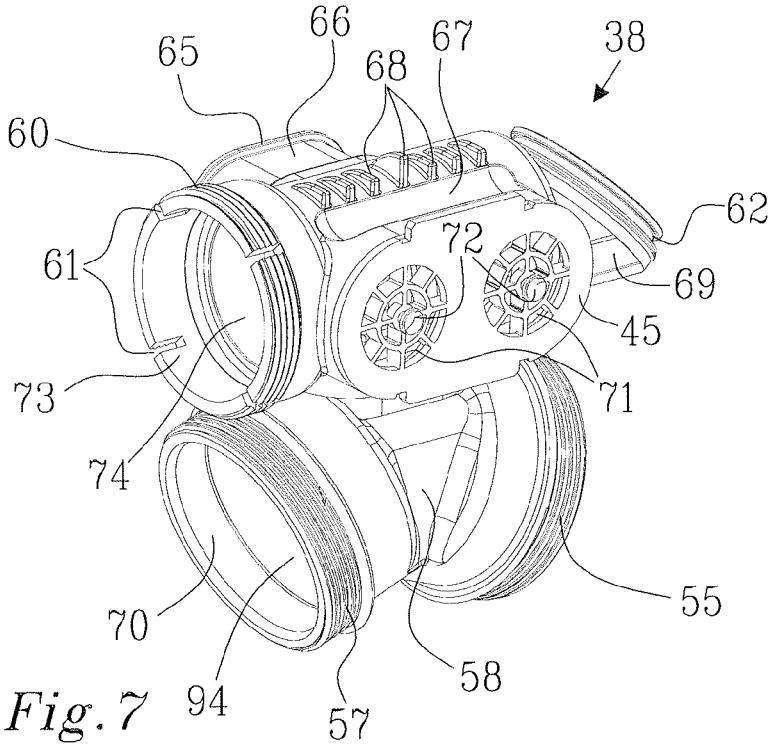

FIG. 7 shows the same elements as FIG. 6 but in a front isometric view. Outer downstream sealing surface 70 in the closed circuit segment 58 permits the creation of a fluid-tight seal between flexible hose 2 and closed circuit segment 58 by means of combined sealing and fastening ring 29. Inner downstream sealing surface 94 provides a fluid-tight seal between the closed circuit segment 58 and downstream checkvalve holder 49 by means of sealing means 51 (cf. e.g. FIG. 4 or 5). Internal sealing surface 73 of inlet port 74 provides a fluid-tight seal between open circuit segment 59 and the switch means 42 sub-assembly by means of sealing means 44 (cf. e.g. FIG. 4 or 5). Sealing means 44 permits rotation and translation of switch means 42 while still maintaining a fluid-tight seal between the environment and the interior of closed circuit segment 58. A plurality of gas pathways 71 in exhaust plenum 45 permit the escape of exhaled breathing gas when the mouth piece 1 is operated in open-circuit mode. Locking capstans 72 centrally located to the exhaust gas pathways, allows for the secure mounting of checkvalve means 46 and 47, such that checkvalve means 46 and 47 selectively allow the passage of exhaust gas out of the integrated mouthpiece and into the environment while preventing entry of the environment fluid into the mouthpiece housing. Checkvalve means 46 and 47 are conventional and will not be described further.

Figure 8:
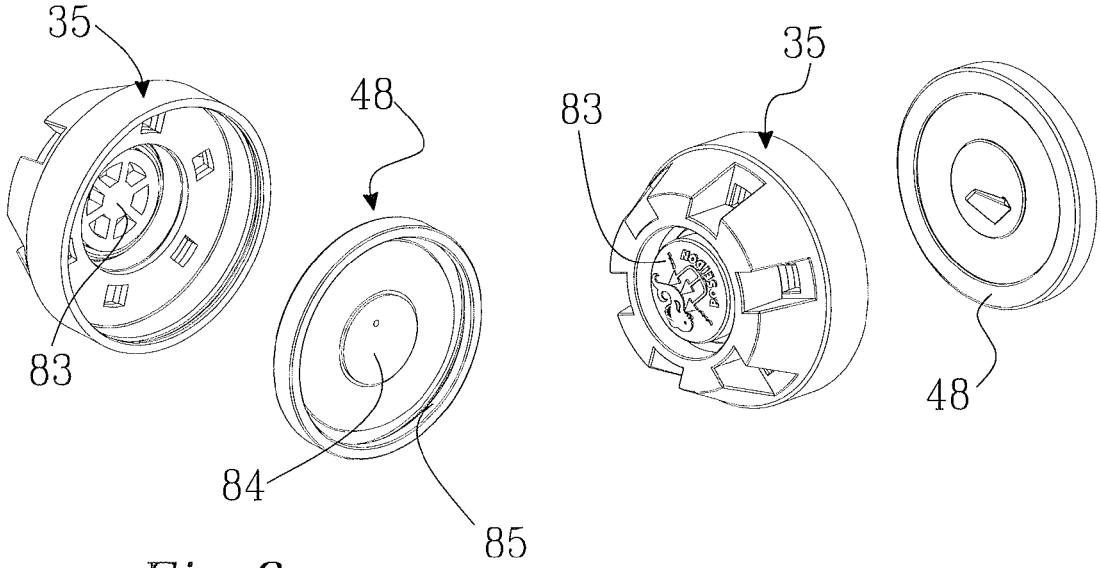
FIG. 8 shows a flexible diaphragm and its safety cover.

FIG. 8 shows a detailed view of the breathable gas addition diaphragm trigger portion 35. The diaphragm trigger portion 35 comprises a shock resistant safety cover that incorporates a flexible central button 83 (advantageously made of some elastic material bonded to the structural material). The flexible central button 83 is arranged such that it will actuate the diaphragm 48 when it is pressed. This enables the user to manually activate the open-circuit second-stage regulator 99 if desired by depressing the button 38, which will cause the flexible diaphragm 48 to be moved inward into mouth piece housing 38 along a direction D (cf. e.g. FIG. 13). The flexible diaphragm 48 is attached to the mouth piece housing 38 by means of integral male capture ring 85 which engages female capture groove 62 in the mouth piece housing 38. A rigid disk is arranged at the center of the flexible diaphragm 48 arranged to contact the open-circuit trigger lever 112 while preventing abrasion damage to diaphragm 48. The flexible diaphragm 48 is caused to move inward into mouth piece housing 38 when there is a pressure drop inside mouth piece housing 38 relative to the ambient fluid pressure (whether atmospheric air, water or other surrounding fluid).

Figure 9:
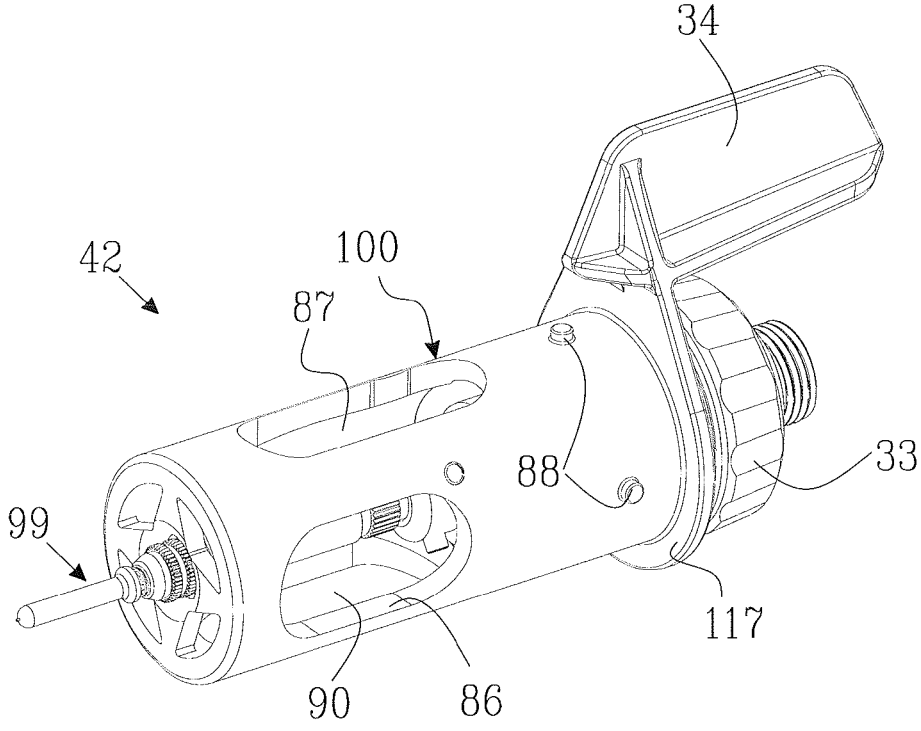
FIG. 9 shows switch means utilized in an embodiment of the present invention.

FIG. 9 shows a closeup of switch means 42. All components in this figure have been previously identified. However, FIG. 9 does show for the first time how second-stage regulator 99 fits into the switch barrel 100 and is held in place within the switch barrel by retainer means 39.

Figure 10:
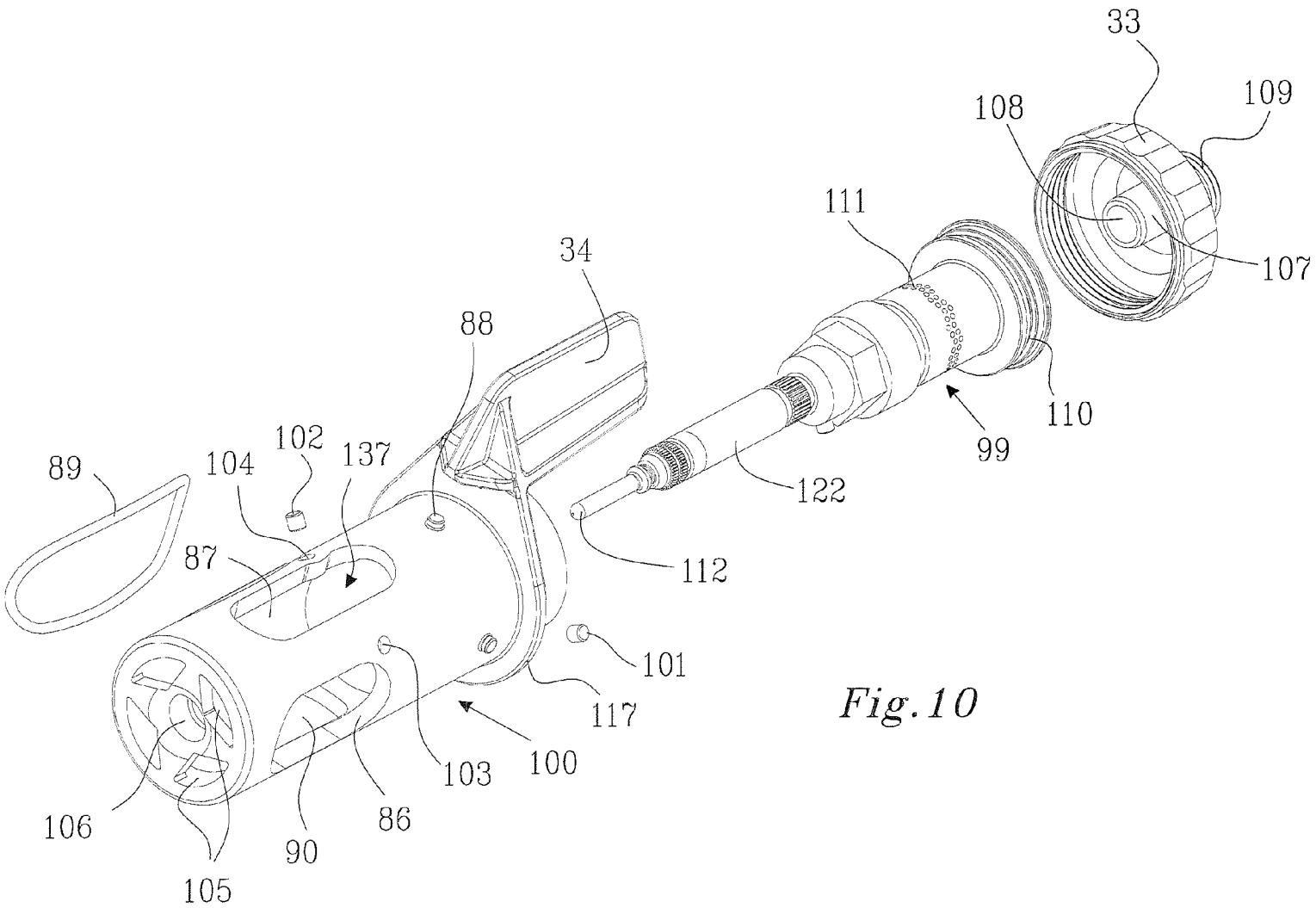
FIGS. 10-11 shows the switch means from FIG. 9 in exploded view.

FIG. 10 shows an exploded view of the switch means 42. The switch means 42 comprises a switch barrel 100 comprising substantially longitudinal cylindrical and hollow form. A plurality of gas passageways 105 is arranged in the end face of switch barrel 100 that serve to communicate with cylindrical inner chamber 137 in the vicinity of flexible diaphragm 48 so as to allow an induced pressure drop in the cylindrical inner chamber 137 of housing 38. The pressure drop activates the open circuit second-stage regulator 99 by causing the diaphragm 48 to contact a valve trigger mechanism, preferably in the form of gas addition trigger lever 112. At contact the valve trigger mechanism 112 activates the open circuit second stage regulator 99 and gas is added.

A valve tube 122 for open circuit second stage regulator 99 is secured near its end point for structural reasons by hole 106 in the end face of switch barrel 100. When trigger lever 112 is activated it causes low pressure 8 to 12 bar breathing gas to be injected into the mouth piece housing 38 from which it is then made available to the user. The open circuit second stage regulator 99 body is sealed at its entry point into switch barrel 100 by sealing means 110. The open circuit second stage regulator 99 is thence held into place inside switch barrel 100 by retainer means 33. Low pressure gas passes through gas pathway 108 through the center of retainer 33 and an internal seal in housing of second stage regulator 99 seals against sealing surface 107 in retainer 33 such that gas cannot escape the system other than by the mechanism of activating trigger lever 112. Fastener (thread) means 109 permits flexible hose 32 (not shown) to be connected to second stage regulator 99 in a secure and gas-tight fashion.

It is preferred that, as shown in FIG. 10, that the second stage regulator 99 is inserted substantially co-axially with the central axis of switch barrel 100 and that it is at least partly embedded within switch barrel 100. This 2-in-1 integration of what would normally be two separate systems into one tightly integrated system permits the integrated mouth piece 1 according to an embodiment of the invention to be both extremely compact and lightweight. This approach represents a significant improvement over the prior art, where all previous designs employ second stage regulators as independent entities relative to the switch barrel and this leads to large, blocky designs that are both heavy in air and negatively buoyant in water and thus lead to diver fatigue when trying to hold the mouthbit 31 for significant periods of time.

FIG. 10 further shows magnet cavities 103 and 104 which can be arranged to receive open-circuit and closed-circuit state detection magnets 101 and 102 (cf. FIG. 15), respectively, forming part of a sensor device. The purpose of these magnets and such a sensor device will be explained in detail below.

Figure 11:
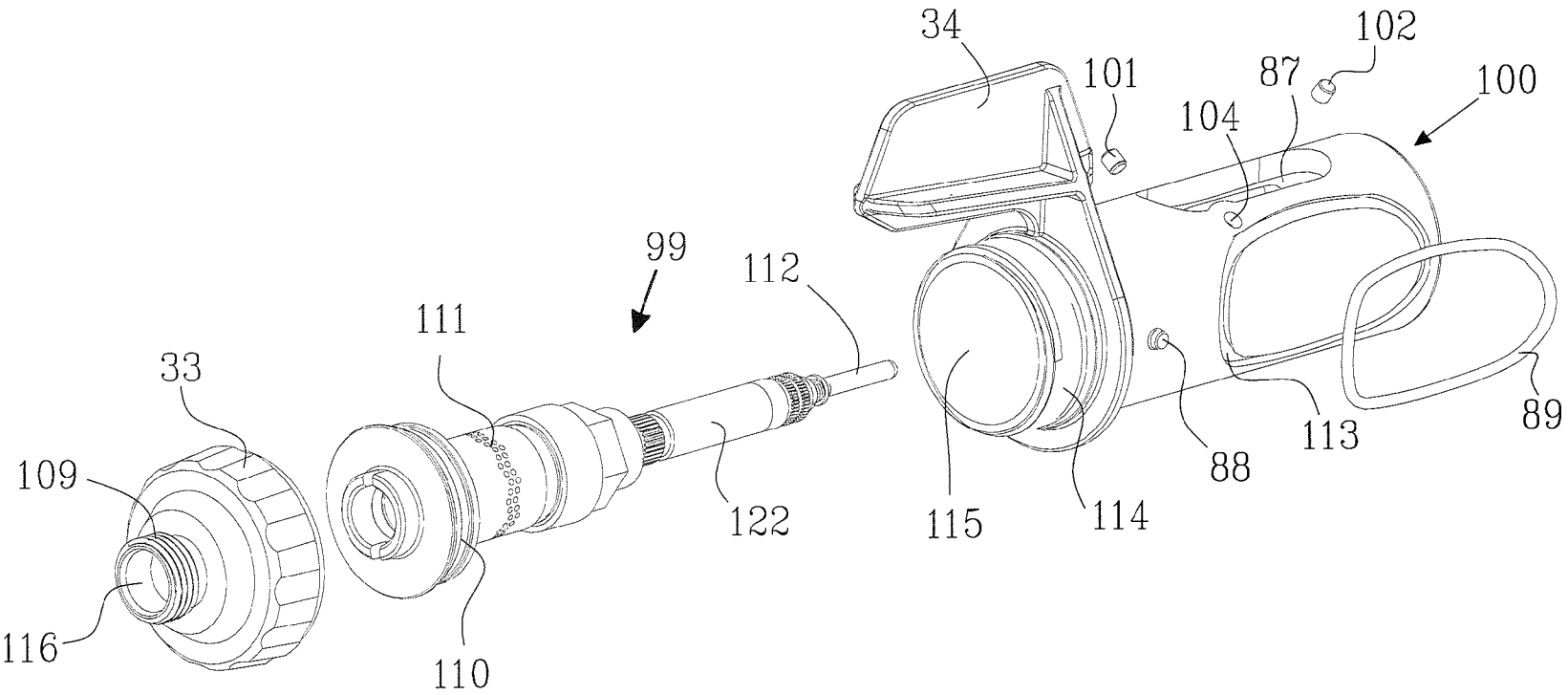

FIG. 11 shows an alternate front isometric view of the switch means 42 sub-assembly in exploded view. A seal groove 113 is arranged in the outer surface of switch barrel 100 and face sealing means 89, which is preferably an o-ring type seal. Preferably, as partly shown in FIG. 11, groove 113 is of a "dovetail" variety in which the width at the base of the groove is wider than the entry width. This is preferred to retain the gas seal 89 as the switch barrel 100 is rotated. Finally, flexible hose 32, which supplies low pressure breathing gas to the mouthpiece second stage regulator 99, connects to retainer nut 33 by means of thread means 109 and the hose is sealed to sealing surface 116 such that substantially no gas leaks from the connection point but is instead channeled internally to the open circuit second stage regulator 99.

Figure 12:
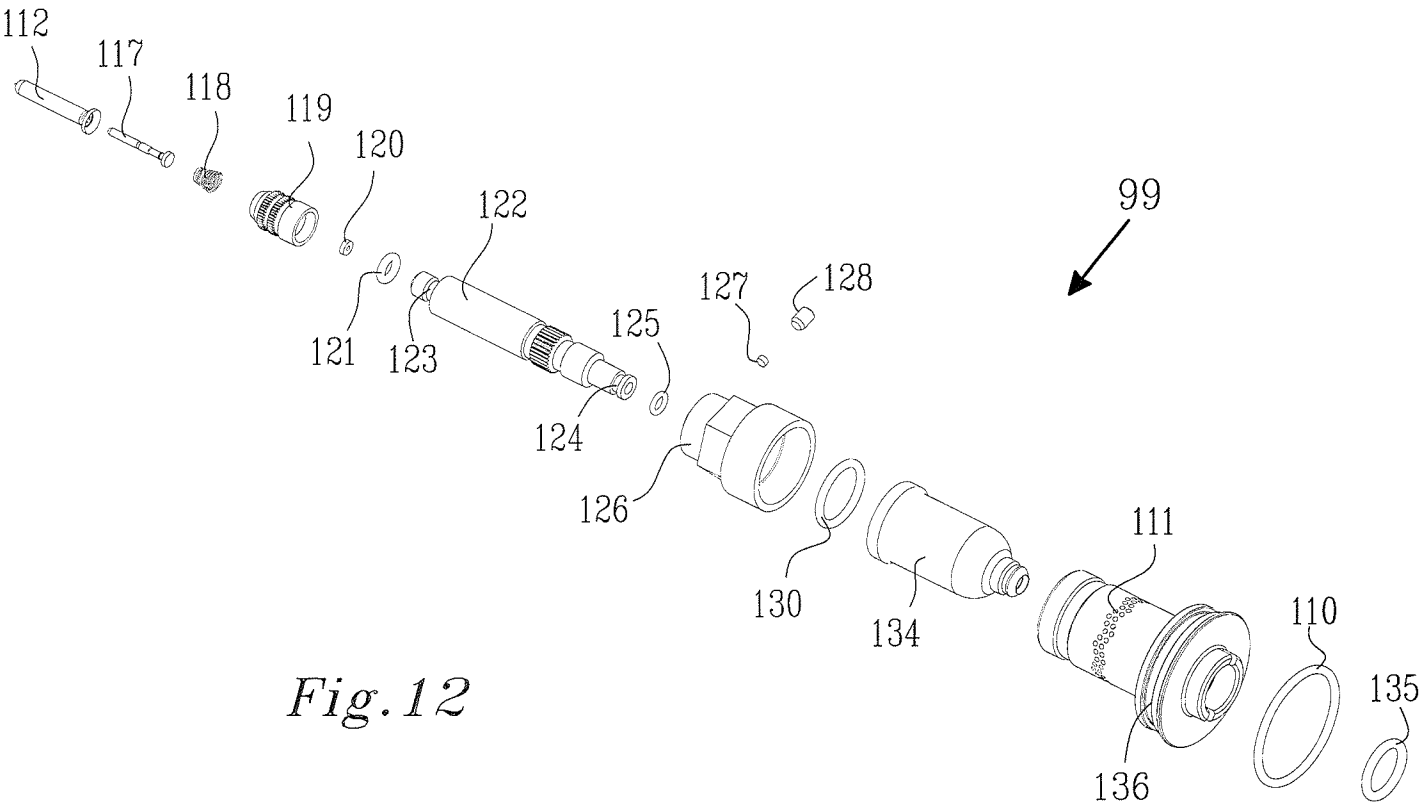
FIG. 12 shows a second stage regulator in exploded view.

FIG. 12 shows an exploded view of the open circuit second-stage regulator 99. This is a modified commercial second-stage regulator in which the valve tube 122 has been extended to accommodate the needs for integrating both an open-circuit function and an ADV (automatic diluent-addition valve) function into the integrated mouthpiece 1. Gas addition is initiated by opening the regulator 99, preferably via a induced lateral movement to a pilot (servo) style valve comprised of a trigger lever 112, trigger lever metal core 117, spring 118 valve knife edge 119 and elastomeric valve seat 120. The pilot valve is screwed to valve tube 122 and is sealed to valve tube 122 with an o-ring seal 121 that resides in a groove 123 in valve tube 122. The valve tube 122 is sealed to valve housing nut 126 with an o-ring seal 125 which resides in a groove 124. In order to allow for a very fine adjustment of the triggering tension, the valve tube 122 is screwed into housing nut 126 and its position of insertion is locked by rubber plate 127 which is held in compression by set screw 128. Valve insert 134 is sealed to housing nut 126 by face seal 130 so that no gas escapes and that there is maintained a direct pneumatic connection between all of the internal volume inside second-stage regulator 99 from valve insert 134 to pilot valve seat 120. Under normal operation valve insert 134 resides inside valve housing 136 and seals a plurality of radial holes drilled inside the hollow housing 136, thus preventing the escape of low pressure breathing gas through holes 111.

The entire second-stage regulator 99 is sealed to switch barrel 100 by o-ring seal 110. O-ring seal 135 resides in a female groove inside valve housing 136 and seals against surface 107 inside retainer mean 33 such that, again, no mechanism for escape of the low pressure supply gas is allowed except under controlled circumstances.

During operation of either the open-circuit mode of the integrated mouthpiece 1 or activation of the ADV system during closed-circuit mode, the flexible diaphragm 48 impinges on trigger lever 112 due to the creation of reduced pressure inside mouthpiece housing 38. When trigger lever 112 is displaced laterally, pilot valve seat 120 is unseated, which allows the pressure inside tube 122 to reduce and thereby permit a flexible diaphragm on the exterior of valve insert 134 to temporarily collapse. When valve insert diaphragm 134 collapses, it exposes holes 111 to the low pressure supply gas which then vents into cylindrical inner chamber 137.

An advantage of using this style of second stage regulator is that it permits an extremely compact internal switch core that doubles as the automated gas addition system for both open-circuit mode operations as well as for ADV gas addition while operating in closed-circuit mode.

Figure 13:
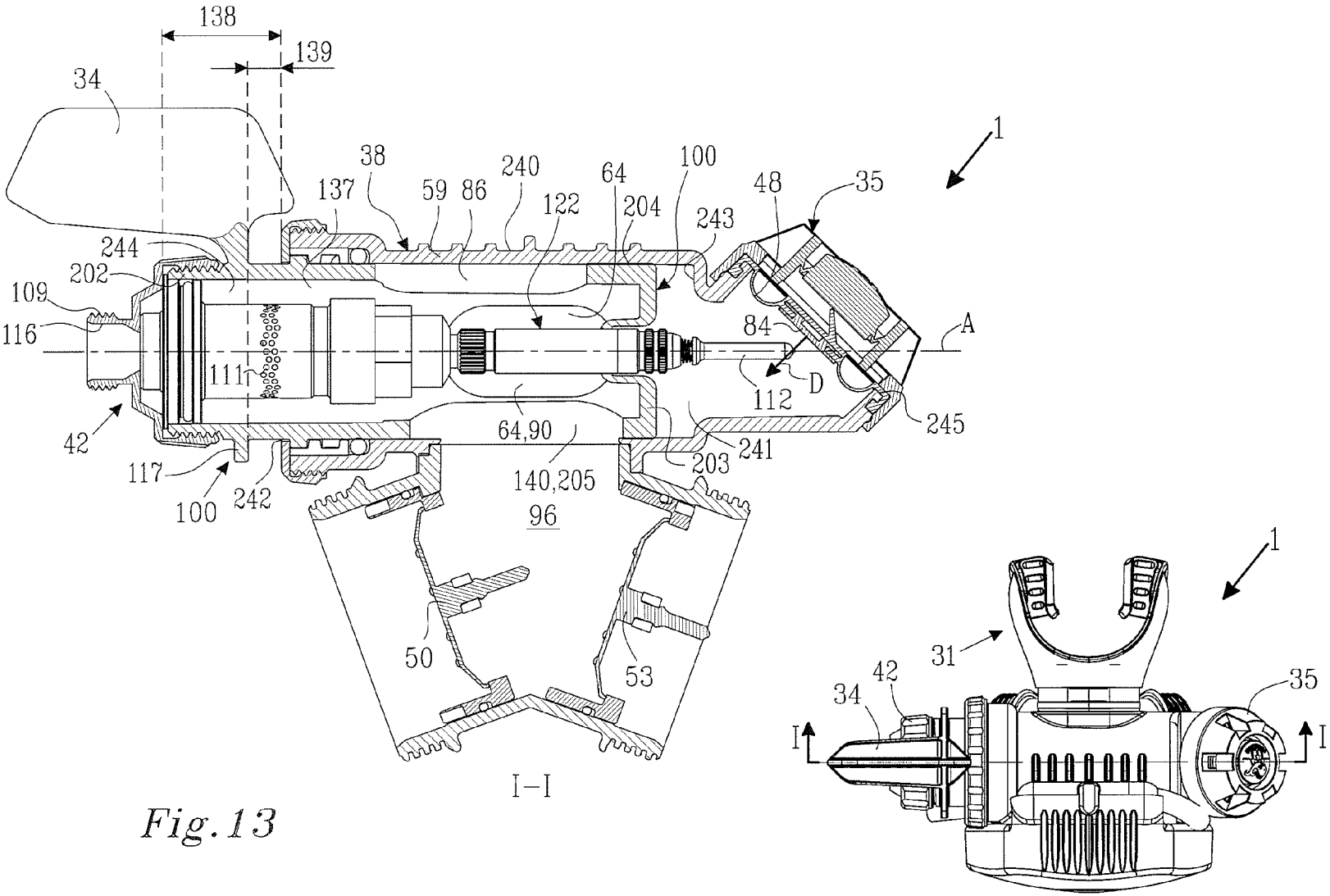
FIGS. 13-14 shows a cross section of a mouth piece according to the present invention.

FIG. 13, section I-I shows a vertical cross section of the housing 38 of the mouth piece 1, with a view out from the housing 38 and the mouthbit 31 (and towards a user during use). The switch barrel 100 is in the closed-circuit mode position and not shown in cross section.

More specifically, FIG. 13 shows a mouth piece housing 38 comprising an open-circuit segment 59 comprising a substantially cylindrical sleeve, preferably being open at both ends and preferably extending substantially symmetrically along a longitudinal axis A. The open-circuit segment 59 further comprises a substantially cylindrical outer surface 240 and a substantially cylindrical inner surface 241 comprising a first and a second end 242, 243 respectively and a cylindrical inner chamber 137.

A flexible diaphragm 48 and an open-circuit diaphragm trigger portion 35 are arranged on the open-circuit segment 59, preferably on a projection 245 which projects away from the longitudinal axis A at an angle. Preferably, the angle is about 45 degrees in case the open-circuit diaphragm trigger portion 35 is used, but the angle can be between 0-90 degrees dependent upon type of trigger mechanism used. As described earlier, the flexible diaphragm 48 is arranged at the second end 243 of the open-circuit segment 59 and closes off that end towards the ambient environment. The flexible diaphragm 48 is in communication with the cylindrical inner chamber 137.

The open-circuit trigger portion 35 is arranged to be pressed by a user so as to contact the flexible diaphragm 48 and thereby flex the flexible diaphragm 48 from its original and first position along a direction D (illustrated in FIG. 13). The flexible diaphragm can flex a maximum flex distance FD, which is determined by properties of the flexible diaphragm 48, e.g. such as the material used, the diameter, the shape and form, and the like. In this embodiment of the present invention, the flexible diaphragm 48 provides for, together with the open circuit second-stage regulator 99 as mentioned above, an automatic diluent valve function.

The mouth piece housing 38, and in this embodiment of the present invention the open circuit segment 59, comprises a mouth piece breathing part opening 64 (cf. FIG. 6) in the form of a substantially oval opening through the wall of the mouth piece housing 38. The mouth piece breathing part opening 64 is arranged substantially in the middle between the first and the second end 242, 243 of the open circuit segment 59. Further arranged substantially in the middle between the first and the second end 242, 243 of the housing 38, but on a distance apart from the piece breathing part opening 64, are a first exit port 205 (cf. FIG. 5), for exhausting gas from said mouth piece housing 38 into a closed circuit flow channel via a closed-circuit lower housing volume 96, and a second exit port 206 (cf. FIG. 5), for exhausting gas from said housing 38 into an ambient environment. The first and the second opening 205, 206 are arranged as substantially oval openings through the wall of the mouth piece housing 38.

Arranged at least partly inside the mouth piece housing 38, and aligned with the longitudinal axis A, is a switch barrel 100 comprising a substantially longitudinal cylindrical and hollow form. The switch barrel 100 comprises a first and a second end 202, 203, an outer and an inner surface 204, 205 respectively. The switch barrel 100 comprises an outer diameter which is slightly less than the diameter of the cylindrical inner chamber 137 of the open-circuit segment 59 (cf. FIG. 4) so that the switch barrel 100 snugly fits at least partly inside the cylindrical inner chamber 137. At least one sealing member, such as an O-ring 89 (cf. FIG. 11), is arranged partly between the switch barrel 100 and the cylindrical inner chamber 137, to provide a liquid- and preferably air tight seal there between.

As mentioned above, the switch barrel 100 is at least partly arranged inside the mouth piece housing 38, and in this embodiment of the present invention, in the open circuit segment 59. A first section 138 of the switch barrel 100 extends out and beyond from the first end 242 of the mouth piece housing 38. The first section 138 of the switch barrel 100 is hence accessible from the outside of the mouth piece housing 38. Attached to the first section 138 is the switch lever 34 arranged to impart leverage during use, so that the switch barrel 100 can be turned in a tangential direction with respect to the cylindrical inner surface 241 of the mouth piece housing 38 and the open circuit segment 59, preferably around the longitudinal axis A. The first end 202 of the switch barrel 100 comprises as mentioned earlier a connection 33 to a flexible hose 32 (as shown in FIG. 2) to provide a gas, such as a diluent gas, substantially directly to the user mouth, during use. More generally, the first end 202 of the switch barrel 100 provides for an inlet port for the gas, the inlet port being in communication with the open circuit second stage regulator 99.

As mentioned, arranged inside the switch means 100, and substantially aligned with the longitudinal axis A, is an open circuit second stage regulator 99 arranged. The open circuit second stage regulator 99 comprises as mentioned earlier a trigger lever 112, i.e. an adjustable valve trigger mechanism. The adjustable valve trigger mechanism functions as an adjustable open-circuit regulator valve and an ADV. In the regulator 99 according to the present embodiment the open-circuit function and the ADV function are accomplished by adjusting the position of the trigger lever 112.

The adjustable valve trigger mechanism can be arranged, adjusted and calibrated in numerous of different ways. Example methods for tuning the adjustable valve trigger mechanism will be described in greater detail below.

As seen in FIG. 13, a gap exists between the end of trigger lever 112 of the second-stage regulator 99 and the face plate 84 of the flexible diaphragm 48. In this embodiment of the present invention, the gap is established precisely by precision setting of the position of the open circuit second stage regulator 99 such that the trigger pressure drop (that is, negative pressure differential inside mouth piece housing 38 relative to the external ambient pressure) for an ADV-function in closed-circuit mode is approximately 30 mbar (30 millibar=3,000 Pa) which has been measured empirically to be the pressure drop associated with the best external ADV (automatic diluent-addition valve) systems in use today.

Although this embodiment of the present invention uses the principle of adjusting the valve trigger mechanism during use by e.g. moving the valve trigger mechanism a distance away from the flexible diaphragm, the open circuit second stage regulator 99 can during the manufacturing process or assembly process advantageously be calibrated. The calibration of the open circuit second stage regulator 99, i.e. the adjustable valve, is done by means of elongate the tube 122 as compared with a conventional open circuit second stage regulator, this is a simple and robust way which only requires the specific tube 122 to be altered, otherwise the open circuit second stage regulator can be maintained substantially unchanged. As an alternative, the adjustable valve can be tuned by e.g. making the trigger lever 112 somewhat longer. However, regardless of the method for tuning the adjustable valve, it is the relative distance between the valve trigger mechanism, in this case the trigger lever 112, and the flexible diaphragm 48 which adjusts the required pressure trigger drop, i.e. a negative pressure differential, also referred to as a cracking pressure.

Arranging the ADV cracking pressure to be less than approximately 30 mbar would lead to premature (and therefore wasteful) gas. Similarly, increasing the cracking pressure for the ADV to be significantly more than approximately 30 mbar would lead to difficulty in breathing when the compliant gas volume in the breathing apparatus falls below the lung volume of the user for any of the many reasons explicitly defined earlier in this document. The arrangement shown in FIG. 13 thus requires the presence of the user to create a negative pressure differential inside cylindrical inner chamber 137, and the open circuit segment 59, of approximately 30 mbar such that flexible diaphragm 48 will be drawn inward whereupon it will contact the trigger lever 112 and open the open circuit second stage regulator 99, which thereupon adds gas via a plurality of holes 111, into cylindrical inner chamber 137, and thence through gas pathway 86 (cf. FIG. 9) to the user until full lung volume has been restored.

In this embodiment of the present invention, the relative distance between the valve trigger mechanism and the flexible diaphragm 48 is approximately 5-6 mm. Preferably, the relative distance between the valve trigger mechanism and the flexible diaphragm 48 should not exceed the maximum flex distance FD of the flexible diaphragm 48.

Once user lung volume has been restored, the exhaled breath proceeds through gas pathway 86, through the center of switch barrel 100 via cylindrical inner chamber 137, out through the first exit port 205 (cf. FIG. 5), i.e. in this embodiment the gas pathway 90 (cf. FIG. 9), through gas pathway 140 and thence into the closed-circuit lower housing volume 96 whereupon it will exit via checkvalve 50 and proceed to the gas processing unit. Return gas from the gas processing unit will enter the closed-circuit lower housing volume 96 via checkvalve 53. It will be noted that the second exit port 206, in this embodiment of the present invention the plurality of gas pathways 71, is now effectively blocked by the switch barrel 100 (preferably a wall part of the cylindrical switch barrel 100) and thus does not play a role in closed-circuit operation.

In an alternative embodiment of the present invention, the switch barrel 100 is arranged to adjust the relative distance between the valve trigger mechanism and the flexible diaphragm 48 by means of adjusting the position of the flexible diaphragm 48. In yet an alternative embodiment of the present invention, both the valve trigger mechanism and the flexible diaphragm 48 can be adjusted to change the relative distance between the valve trigger mechanism and the flexible diaphragm 48. In an additional embodiment of the present invention, the switch means 42 or similar can be arranged to electronically adjust the a valve trigger mechanism, e.g. such as the trigger lever 112 or similar, preferably while directing the exhaust gas between the first and the second exit port 205, 206. An electronic adjustment may e.g. be done by means of an electronic motor or other actuator means, e.g. if it is the position of the valve means, or the trigger lever 112 or the flexible diaphragm 48 which is to be adjusted. However, it may also be that the electronic adjustment is done by means an electromagnetic valve or other actuator means, which changes its pressure threshold in any conventional way.

It is therefore within the boundaries of the present invention that the actuation means for adjusting the valve trigger mechanism (from closed-circuit ADV mode to open-circuit mode) is accomplished not by a helical nut, but rather by a simple rotation of the switch barrel with no translation involved, yet a detection system detects the change in switch state and then, by computer control, actuates a mechanism (means) that adjusts the valve trigger mechanism to achieve the same effect of de-tuning second stage 99 for the ADV function while optimally tuning it for open-circuit function. This can be done in many ways: a servo motor, through electropneumatics, through piezo electric stacks, flexure systems, and amplifiers, or from simple motor actuation of the translation or solenoid actuation of the translation (e.g. an electro magnet causes the translation to take place). A combination of a manual actuation and of a computer controlled actuation as described above is also possible.

Figure 14:
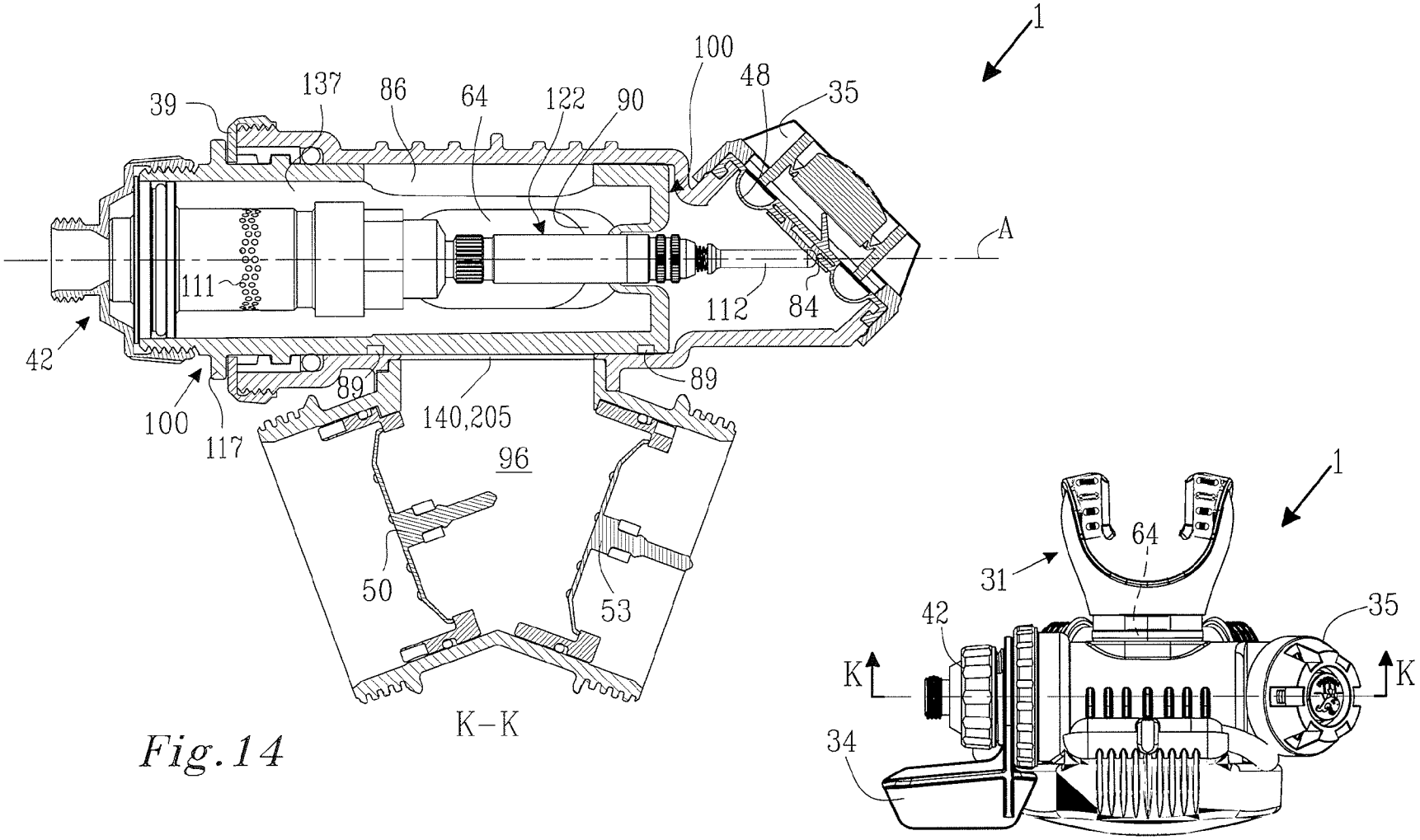

Referring to FIG. 14, section K-K, shows the same view as in FIG. 13, except that now switch means 42 is positioned in the open-circuit position. We now see that the switch means 42 has moved inward a distance 139, approximately corresponding to 5.5 mm in this embodiment, and that the stopping flange 117 on switch barrel 100 has now come up adjacent against the exterior face of retainer ring 39 and can rotate no further. This is at a position rotated approximately 90-degrees clockwise from the previous position shown in FIG. 13 (with clockwise being defined as rotating switch lever 34 away from the user). The trigger lever 112 is lightly touching diaphragm plate 84 of the flexible diaphragm 48 is under very slight tension. The amount of differential pressure required to trigger gas addition via the second-stage regulator 99 in the state shown in FIG. 13 has been empirically measured to be less than 4 mbar, which places this device in the realm of very high performance dedicated open-circuit regulators. This arrangement represents a multi-point balance between the needs of an integral, automated diluent-addition valve (ADV), that of a high performance open-circuit regulator, and that of a high performance closed-circuit breathing apparatus. It is the relative motion between the valve trigger mechanism, in this case the trigger lever 112, and the flexible diaphragm 48, that provides the automatic, and with no other adjustments required by the user, conversion from high performance closed-circuit operation with an integrated ADV to that of a high performance open-circuit regulator with nothing more (from the user's point of view) than an approximately 90-degree rotation of the switch lever 34.

In FIG. 14 it is shown that in open-circuit mode gas pathway 90 (cf. e.g. FIG. 9) of switch barrel 100 is aligned with the mouth piece breathing part opening 64 which leads to user mouthbit 31. Gas pathway 86 for closed circuit breathing is now blocked and is not used. Gas pathway 140, i.e. the first exit port 205, in the closed circuit segment 58 of the mouth piece housing 38 is now blocked by face seal 89 on switch barrel 100, thus preventing the flow of breathing gas into the closed-circuit segment 58.

Head Up Display System

The mouth piece 1 according to the present invention may further be equipped with a head-up display (HUD) sub-system 37 (e.g. shown in FIGS. 2 and 4-5). However, even though the HUD 37 is described below with reference to the mouthpiece 1 according to an embodiment of the present invention, it should be emphasised that the HUD 37 may be used together with other mouthpieces, e.g. for sensing a status or similar of the mouthpiece in question and/or for providing an alarm or other information to the user related to the function or similar of the mouthpiece in question and/or the diving gear (e.g. CCR gear or similar) used together with the mouthpiece in question.

The HUD 37 comprises means for detecting the state of switch lever 34 and relaying that information to a remote computer. Preferably the HUD 37 is a substantially cylindrically shaped electronic device that is attached to the mouth piece 1, e.g. by being snapped onto the mouth piece housing 38. The HUD 37 is connected to a remote computer or similar e.g. in the Electronics Module 8 of the CCR in FIG. 1, preferably via cable 41, although it could equally well be connected to the remote computer via wireless data telemetry using many extant methods (e.g. BlueTooth and other standard protocols).

The HUD 37 attribute has entirely to do with the safety of the user. As described, the present invention is thus so far presented focused on providing introductory level closed-cycle (aka rebreather) breathing apparatus to individuals who are not highly trained professionals. The present invention provides a simple mechanism to escape the complexities of a closed-circuit system, should that become necessary, and enables the user to abort to a safe zone (e.g. the surface of the water if diving) on the more simplistic open-circuit bailout system by means of nothing more than a 90-degree rotation of switch lever 34 and without having to search for any external, auxiliary bailout breathing apparatus in a time of emergency (and hence potential panic).

To make such a system more reliable it is preferred that the control system (a computer, such as an an-board computer in e.g. arranged in the Electronics Module 8, and its associated sensors, actuators, displays, illuminators, power supplies, and emergency annunciators) be able to sense the state of the integrated mouthpiece 1—that is, whether it is operating in open-circuit or closed-circuit mode.

It is possible with modern high speed embedded system processors to compute hundreds of possible state conditions per second. Thus it is possible to determine at any given time during the course of a mission using the breathing apparatus which state (closed-circuit or open-circuit) is most advantageous to the survival of the user. A simple example (one of scores of possibilities) is for the scenario where the user is operating the breathing apparatus in closed-circuit mode. The onboard computer detects that the onboard oxygen supply (used for metabolic oxygen make up in a closed-cycle breathing apparatus) is empty and at the same time the partial pressure of oxygen in the breathing gas is decreasing towards a hypoxic limit, while at the same time the tank pressure associated with a diluent breathing gas supply is nearly full. The computer, amongst hundreds of possibilities (state machines) can thence deduce in this scenario that it is not safe to continue in closed-circuit mode and that it will definitely be safe to switch to open-circuit mode. The computer, by a means we will shortly describe, is able to detect that the user is operating the breathing apparatus in closed-circuit mode. It therefore uses an annunciation system to notify the user to switch (that is, to rotate lever 34) to open-circuit position. The user, upon sensing this annunciation, and understanding in advance that the annunciation system is un-ambiguous on this subject, switches to open circuit mode and aborts the mission (for a dive, the diver surfaces to the surface of the water if this condition arises).

Figure 15:
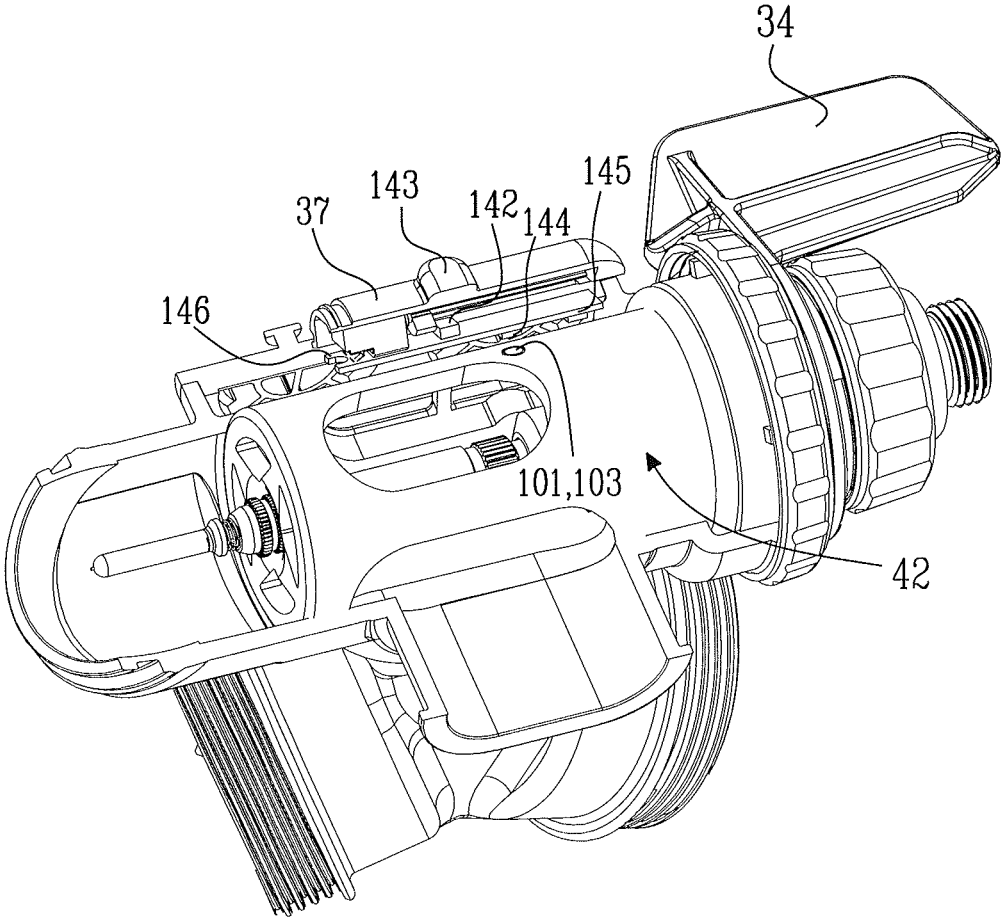
FIGS. 15-17 shows part of a housing, switch means and parts of a head-up display system.

In FIG. 15 such a system is shown. A portion of open circuit segment 59 is shown in cross section to reveal the switch barrel 100 with magnet 101 stored in pocket 103 (cf. FIG. 10) in alignment with a magnetic field detector 144 that is located on a small printed circuit board 146 inside the HUD 37 (head-up display). The position shown is the open-circuit position for switch lever 34 and switch means 42. Magnetic sensor device 144 can be of many varieties including simple reed switches to more sophisticated Hall Effect sensors, all of which can be either sensed by a local processor in the HUD 37 or by a remote processor connected either by direct cable connection 41 (cf. FIG. 4) or via wireless communication (e.g. using BlueTooth or lower frequency systems more effectively tailored to the environment at hand).

Figure 16:
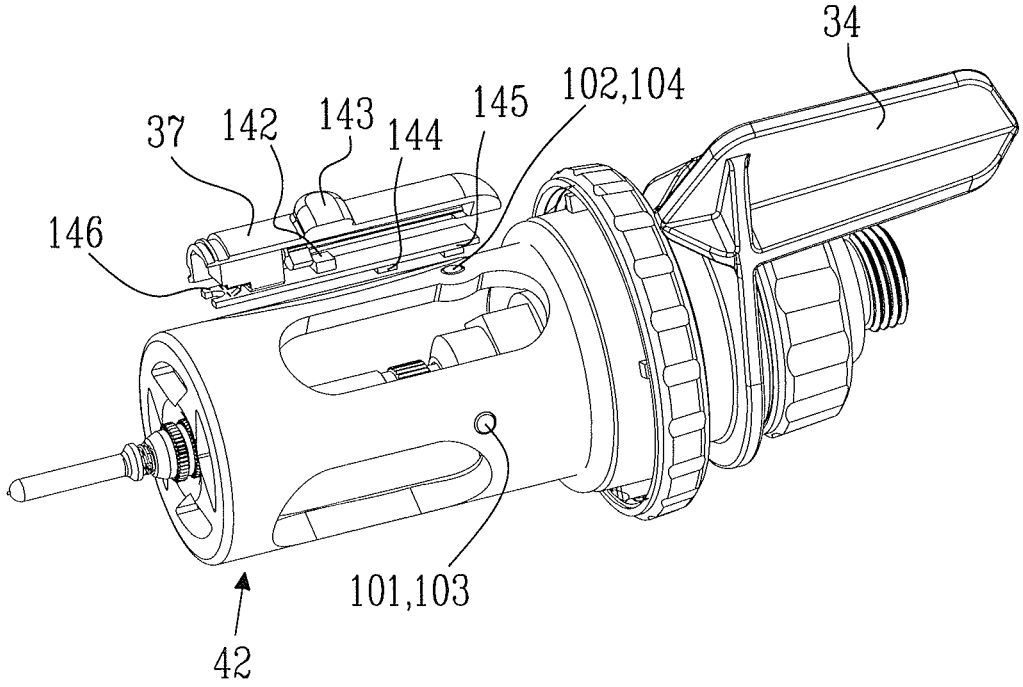

FIG. 16 shows only a section view of the HUD 37 and switch means 42, this time in the closed-circuit configuration. Now magnet 102 in receptacle hole 104 (cf. FIG. 10) is aligned with magnetic sensor 145 on the printed circuitry board 146 of the HUD 37. Note that magnetic sensors 144 for open-circuit and 145 for closed-circuit are physically displaced from one another. One can use polarization sensitive detectors, as well, for the detection of the valve state to improve rejection of ambiguous states and thus improve the ability for the control system processor to accurately know the state of the mouthpiece. In this simple HUD 37 concept we provide annunciator means 143, e.g. an LED (light emitting diode) or similar light means and/or sounding means and/or vibrating means. The purpose of the LED in the present invention, unlike simple LED HUD systems that have been developed by the authors and others for the purpose of conveying quantitative information—e.g. the level of partial pressure of oxygen—is to provide only one piece of unambiguous information to the user: that they must switch the mouthpiece position. The simplest configuration is that the user is presumed to be operating in closed-circuit mode and if a non-recoverable situation, such as described above, is detected by the onboard computer, then the computer causes the HUD LED to light up, thereby commanding the user to switch to open-circuit mode by rotating switch lever 34 approximately 90-degrees to the open-circuit position. The HUD LED light goes out when the computer detects that the user has in fact made the proper switch.

It is however possible to do more sophisticated analyses that may advise a user who, for many reasons, may be operating in open-circuit mode and may be in danger of exhausting all breathing gas available to them while, on the other, hand, it may be safe to switch back to closed-circuit operation. In that instance, it then becomes imperative to have a mechanism for the onboard computer to detect that the user is operating the device in open-circuit mode and that it is dangerous to continue doing so but that it is safe to use the device in closed-circuit mode. In this case the HUD LED and other annunciators, must be able to unambiguously advise the user to revert to the alternate position.

The method for doing so can either be to again light the LED and activate other annunciators the same as for switching to open-circuit (the message always meaning "change the state of the mouthpiece, no matter what state you are currently in"), or, alternatively, a simple "reverse" signal—potentially a flashing LED light—that indicates the direction of the required switch.

In all these cases, which require no further elaboration here, we claim a mouthpiece system that is equipped with sensor systems that allow a remote computer to detect the state (open-circuit or closed-circuit) of the convertible, fully integrated mouthpiece system described herein.

Figure 17:
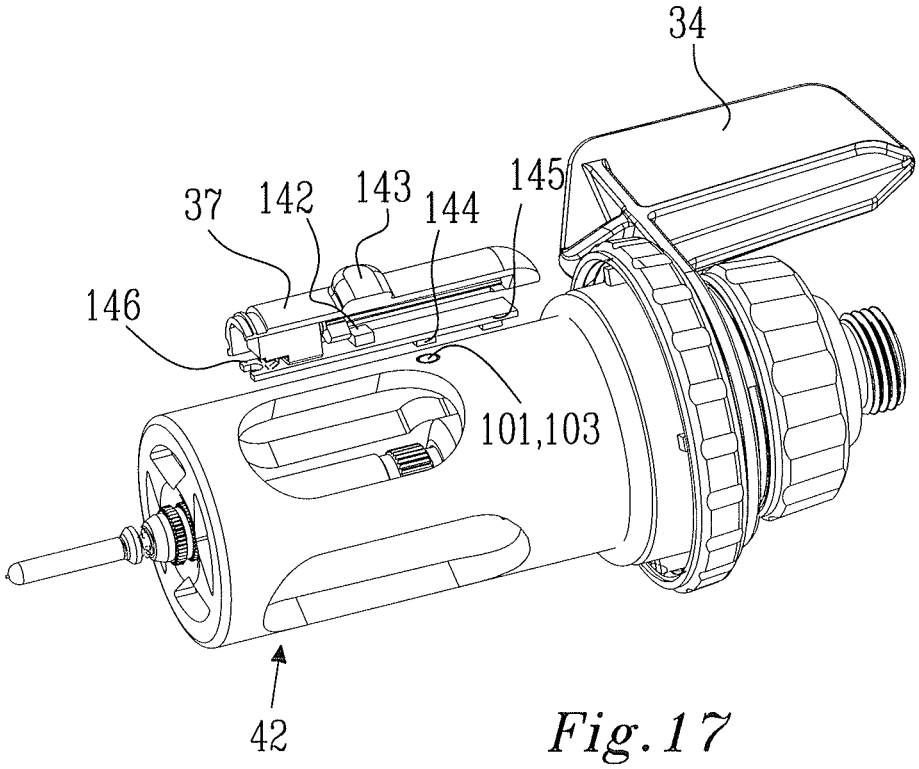

FIG. 17 shows the same view as FIG. 15 (in open-circuit mode) but with the housing removed as in the fashion of FIG. 16. Here, as before, we see that magnet 101, in receptacle hole 103 is now aligned with magnetic field detector 144, which is located advantageously on HUD printed circuitry board 146 so as to create the best possibility of unambiguous detection of magnet 101 by detector 144 and that when magnet 101 is rotated away (when lever 34 is moved from the open-circuit position shown here to that of a closed-circuit position shown in FIG. 16) that magnetic detector 144 ceases to be activated by magnet 101 and is neither activated by magnet 102, but that in that state detector 145 unambiguously detects magnet 102, and vice versa.

The invention claimed is:

1. A mouth piece for a breathing apparatus, said mouth piece comprising:

a valve assembly including a valve trigger mechanism arranged to operatively open and close said valve assembly;

a mouth piece housing comprising:

a mouth piece breathing part opening structured to allow inhaling and exhaling a breathable gas by a user, an inlet port structured to allow breathable gas into said mouth piece housing, said inlet port being in communication with said valve assembly arranged to operatively open and close said inlet port, a first exit port structured to allow gas to exhaust from said housing into a closed circuit flow channel, and a second exit port structured to allow gas to exhaust from said housing into an ambient environment; and a switch assembly to selectively direct said exhaust gas between said first exit port and said second exit port, wherein said switch assembly is further arranged to adjust the opening and closing function of said valve trigger mechanism such that said valve trigger mechanism is activated by a first pressure threshold when said switch assembly is arranged to direct said exhaust gas to said first exit port and a second pressure threshold when said switch assembly is arranged to direct said exhaust gas to said second exit port.

2. The mouth piece according to claim 1, wherein said adjustment of said valve trigger mechanism is simultaneously done when selectively directing said exhaust gas between said first and second exit port.

3. The mouth piece according to claim 2, wherein said valve trigger mechanism is arranged in working cooperation and to be triggered by a flexible diaphragm at said first and second pressure thresholds.

4. The mouth piece according to claim 3, wherein said first pressure threshold is about 20-40 mbar when said valve assembly is arranged to direct said exhaust gas to said first exit port.

5. The mouth piece according to claim 4, wherein said second pressure threshold is about 2-10 mbar when said valve assembly is arranged to direct said exhaust gas to said second exit port.

6. The mouth piece according to claim 5, wherein said adjustment of said valve trigger mechanism comprises moving said valve trigger mechanism and said flexible diaphragm a relative distance with respect to each other.

7. The mouth piece according to claim 6, wherein said valve trigger mechanism is adjusted by moving said valve trigger mechanism with respect to said flexible diaphragm.

8. The mouth piece according to claim 7, wherein said valve trigger mechanism is adjusted by moving said flexible diaphragm with respect to said valve trigger mechanism.

9. The mouth piece according to claim 8, wherein said relative distance is between 1-20 mm.

10. The mouth piece according to claim 3, wherein said flexible diaphragm comprises a maximum flex distance, within which said flexible diaphragm triggers said valve trigger mechanism.

11. The mouth piece according to claim 10, wherein a distance of movement of at least a part of said valve assembly and said flexible diaphragm relative to each other does not exceed said maximum flex distance.

12. The mouth piece according to claim 1, wherein said adjustment of said valve trigger mechanism is at least partly done by moving at least a part of said valve assembly back and forth along a first direction using said switch assembly, when selectively directing said exhaust gas between said first and second exit port.

13. The mouth piece according to claim 12, wherein said mouth piece housing comprises a open circuit segment with a substantially cylindrical form, said open circuit segment comprises a longitudinal axis, wherein said first direction is aligned with said longitudinal axis.

14. The mouth piece according to claim 1, wherein said valve assembly is arranged at least partly inside said mouth piece housing.

15. The mouth piece according to claim 14, wherein said mouth piece housing comprises a substantially cylindrical inner chamber comprising a first end and a second end, and said switch assembly comprises a substantially hollow cylinder at least partly arranged in said substantially cylindrical inner chamber.

16. The mouth piece according to claim 15, wherein said valve assembly is at least partly arranged inside said switch assembly.

17. The mouth piece according to claim 16, wherein said valve assembly is moved between a first position and a second position in order to adjust said valve trigger mechanism.

18. The mouth piece according to claim 15, wherein said switch assembly comprises a first end and a second end, wherein only said second end of said switch assembly is arranged between said first and second end of said cylindrical inner chamber.

19. The mouth piece according to claim 1, wherein said inlet port structured to allow breathable gas into said housing is provided via said switch assembly.

20. The mouth piece according to claim 1, wherein said switch assembly is arranged with at least one sensor device, said sensor device being arranged to detect the position of said switch assembly.

21. The mouth piece according to claim 20, wherein said sensor device is arranged to be in communication with a processing unit, such as a computer, said processing unit being in communication with a second sensor device.

22. The mouth piece according to claim 20, further comprising a display in communication with said sensor device, said display being arranged to indicate redirection of said switch assembly to a user during use.

23. The mouth piece according to claim 22, wherein said second sensor device is arranged to detect a status of the breathable gas.

24. A mouth piece for a breathing apparatus, said mouth piece comprising:

a valve assembly including a valve trigger mechanism arranged to operatively open and close said valve assembly:

a mouth piece housing comprising:

a mouth piece breathing part opening structured to allow inhaling and exhaling a breathable gas by a user, an inlet port structured to allow breathable gas into said mouth piece housing, said inlet port being in communication with said valve assembly arranged to operatively open and close said inlet port, a first exit port structured to allow gas to exhaust from said housing into a closed circuit flow channel, and a second exit port structured to allow gas to exhaust from said housing into an ambient environment; and a switch assembly to selectively direct said exhaust gas between said first exit port and said second exit port so as to switch between a closed circuit and an open circuit, wherein said valve assembly provides an automatic diluent valve function operable in said closed circuit and said valve assembly provides an open circuit regulator function operable in said open circuit, and said switch assembly is arranged to actuate said valve assembly to switch between said automatic diluent valve function and said open circuit regulator function, and wherein said valve assembly is activated by a first pressure threshold when said switch assembly is arranged to direct said exhaust gas to said first exit port and a second pressure threshold when said switch assembly is arranged to direct said exhaust gas to said second exit port.

25. The mouth piece according to claim 24, wherein said first and second pressure thresholds are changed by adjustment of said valve trigger mechanism via said switch assembly.

26. The mouth piece according to claim 25, wherein said valve trigger mechanism is adjusted by moving said valve trigger mechanism a distance along a first direction.

27. The mouth piece according to claim 26, wherein said mouth piece housing further comprises a flexible diaphragm and said valve trigger mechanism is arranged in working cooperation with said flexible diaphragm to activate said automatic diluent valve function.

28. Method of adjusting the opening and closing function of a valve trigger mechanism in a valve assembly arranged on a mouth piece for a breathing apparatus, the method comprising:

providing a mouth piece, said mouth piece including a mouth piece housing comprising:

a mouth piece breathing part opening structured to allow inhaling and exhaling a breathable gas by a user, an inlet port structured to allow breathable gas into said mouth piece housing, said inlet port being in communication with said valve assembly arranged to open or close said inlet port, a first exit port structured to allow gas to exhaust from said housing into a closed circuit flow channel, and a second exit port structured to allow gas to exhaust from said housing (38) into an ambient environment; and a switch assembly to selectively direct said exhaust gas between said first exit port and said second exit port so as to switch between a closed circuit and an open circuit; and adjusting said valve trigger mechanism by switching said switch assembly of said mouth piece between said first exit port and second exit port such that said valve trigger mechanism is activated by a first pressure threshold when said switch assembly is arranged to direct said exhaust gas to said first exit port and a second pressure threshold when said switch assembly is arranged to direct said exhaust gas to said second exit port.

29. The mouth piece according to claim 3, wherein said second pressure threshold is about 2-6 mbar when said valve assembly is arranged to direct said exhaust gas to said second exit port.

30. The mouth piece according to claim 6, wherein said relative distance is between 2-10 mm.

31. The mouth piece according to claim 1, wherein said first pressure threshold is higher than said second pressure threshold.

* * * * *